US006415702B1

(12) United States Patent
Szabo et al.

(10) Patent No.: US 6,415,702 B1
(45) **Date of Patent: *Jul. 9, 2002**

(54) DOUBLE ACTION SEMI-AUTOMATIC HANDGUN

(75) Inventors: Atilla Szabo, Toronto; Borislav B. Vulanovic, Pickering, both of (CA)

(73) Assignee: Angelotti, Inc., Scarborough (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/197,771

(22) Filed: Nov. 23, 1998

(51) Int. Cl.[7] ..... F41A 5/00
(52) U.S. Cl. ..... 89/148; 89/141; 42/70.08
(58) Field of Search ..... 89/148, 150, 163; 42/70.08, 70.05

(56) References Cited

U.S. PATENT DOCUMENTS

| | | | | | |
|---|---|---|---|---|---|
| 939,111 | A | * | 12/1909 | Tambour | 89/148 |
| 984,519 | A | | 2/1911 | Browning | |
| 1,812,905 | A | * | 7/1931 | Stuyvesant | 89/148 |
| 2,927,390 | A | | 3/1960 | Lewis | |
| 3,656,249 | A | * | 4/1972 | Raville | 42/69 |
| 3,722,358 | A | | 3/1973 | Seecamp | |
| 3,733,730 | A | | 5/1973 | Baker | |
| 3,756,120 | A | | 9/1973 | Roy | |
| 3,964,368 | A | * | 6/1976 | Zimeri Safie | 89/141 |
| 4,138,789 | A | | 2/1979 | Langsford | |
| 4,176,584 | A | * | 12/1979 | Thomas, Jr. | 89/138 |
| 4,208,947 | A | * | 6/1980 | Hillberg | 89/148 |
| 4,589,327 | A | | 5/1986 | Smith | |
| 4,833,970 | A | * | 5/1989 | Wilhelm | 89/141 |
| 4,862,618 | A | | 9/1989 | Szabo | |
| 5,036,612 | A | * | 8/1991 | Jennings | 42/70.08 |
| 5,090,147 | A | * | 2/1992 | Pastor | 42/70.05 |
| 5,160,796 | A | | 11/1992 | Tuma et al. | |
| 5,166,458 | A | | 11/1992 | Yoo | |
| 5,267,407 | A | * | 12/1993 | Bornancini | 42/70.08 |
| 5,303,494 | A | * | 4/1994 | Tuma et al. | 42/70.04 |
| 5,400,537 | A | | 3/1995 | Meller et al. | |
| 5,433,134 | A | * | 7/1995 | Leiter | 89/14.5 |
| 5,704,150 | A | * | 1/1998 | Milliman | 42/67 |
| 5,797,206 | A | * | 8/1998 | Vitorino | 42/69.03 |
| 5,808,229 | A | * | 9/1998 | Bastian et al. | 89/163 |

FOREIGN PATENT DOCUMENTS

| | | |
|---|---|---|
| EP | 0 146 359 A2 | 6/1985 |
| EP | 0 579 851 A1 | 1/1994 |
| WO | WO 86/00398 | 1/1986 |

OTHER PUBLICATIONS

Garry James and Jeff John, "Para–Ordnance Goes Double Action", *Guns & Ammo*, pp. 60–66 (Dec., 1998).
Colt Double Eagle Price List, Handgun–Autoloaders, Service & Sport (Handgun announced in 1989).
Three pictures of the Colt Double Eagle.

* cited by examiner

*Primary Examiner*—Charles T. Jordan
*Assistant Examiner*—M. Thomson
(74) *Attorney, Agent, or Firm*—Finnegan, Henderson, Farabow, Garrett & Dunner, L.L.P.

(57) ABSTRACT

A 1911A1 model style handgun that includes a double action trigger assembly. The hammer of the handgun is cocked and released by a drawbar mounted internally to the frame. The handgun also includes a grip mounted safety device to prevent accidental discharging of the handgun and a device to de-cock the handgun without discharging a chambered round.

11 Claims, 26 Drawing Sheets

DOUBLE ACTION SEMI-AUTOMATIC HANDGUN

BACKGROUND OF THE INVENTION

The present invention relates to an improvement for a 1911A1 model semi-automatic handgun. More particularly, the invention relates to a 1911A1 model semi-automatic handgun having a double action trigger assembly.

Handguns are responsible for a significant number of accidental shootings. These accidents occur in both civilian and police settings. To prevent these accidents from occurring, both civilian and police handgun users are switching from single action handguns to double action handguns. A double action handgun is considered safer than its single action counterpart due to the structural and functional differences between them.

In a single action handgun, the trigger assembly serves a single function, namely to release the hammer and discharge the handgun. Prior to discharging the handgun, the hammer must be manually cocked. Once the hammer has been cocked, the trigger assembly need only release the sear to fire the handgun. The recoil action of the discharged round may be used to cock the hammer for subsequent shots.

In a double action handgun, the trigger serves two functions. The first part of the trigger pull serves to cock the handgun by retracting the hammer into engagement with the sear. The second part of the trigger pull disengages the sear, causing the hammer to strike the firing pin and initiate a round held in the chamber. In a conventional double action handgun, the recoil action of the handgun is used to cock the weapon for the next shot, similar to the operation of the single action handgun. Alternatively, in a pure double action only handgun, the hammer always returns to the un-cocked position and a full trigger pull is required to discharge each round.

The double action handgun is consider safer than a single action handgun because it requires a far more deliberate action on the part of the user to fire the weapon. The pull of the double action handgun usually requires between 11 and 15 lbs to fire the weapon, whereas the single action requires between 3 and 6 lbs. Additionally, the double action trigger has a longer pull, compared to that of the single action. A double action handgun is favored by the law enforcement community because the longer and heavier trigger pull aids to prevent accidental shootings due to stress induced loss of fine motor skills.

The 1911A1 model semi-automatic handgun, also known as the government model, is a favorite among the law enforcement community because of the reliability and accuracy of the handgun. However, the 1911A1 model was designed to operate in the single action mode.

An attempt has been made to design a double action 1911A1 model handgun. However, the currently known design has moving parts which are positioned outside the frame of the handgun. This positioning results in the moving parts being potentially exposed to natural elements, such as sand and dirt, while the handgun is being used. Allowing these elements to directly contact the moving parts lowers the reliability of the weapon and increases the required maintenance.

In light of the foregoing there is a need for a 1911A1 model semi-automatic handgun having a low maintenance, reliable double action trigger feature.

SUMMARY OF THE INVENTION

Accordingly, the present invention is directed to an improved 1911A1 model style handgun that obviates one or more of the limitations and disadvantages of the 1911A1 model style handgun. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to an improvement in a 1911A1 model style handgun. The improvement comprises a double action trigger assembly having a drawbar mounted internally to the frame. The drawbar operates to rotate the hammer into a cocked position in which the sear is engaged with the cocked notch on the hammer. The drawbar further operates to disengage the sear from the hammer, thereby releasing the hammer such that the hammer spring acts on the hammer. This causes the hammer to strike the firing pin to initiate a chambered round.

According to another aspect, the invention is directed to a semi-automatic handgun comprising a frame. There is provided a slide mounted on the frame so that the slide is longitudinally moveable on the frame. There is further provided a barrel connected to the frame by a pivot and link so that the barrel moves longitudinally and vertically on the frame. A firing mechanism is provided having a sear, a firing pin, and a hammer with a cocked notch. A double action trigger assembly is provided having a drawbar mounted internally to the frame. The drawbar operates to rotate the hammer into a cocked position in which the sear is engaged with the cocked notch on the hammer. The drawbar further operates to disengage the sear from the hammer, thereby releasing the hammer such that the hammer spring acts on the hammer. This causes the hammer to strike the firing pin to initiate a chambered round.

In another aspect, the invention is directed to a semi-automatic handgun comprising a frame. There is provided a slide mounted on the frame so that the slide is longitudinally moveable on the frame. There is further provided a barrel connected to the frame by a pivot and link so that the barrel moves longitudinally and vertically on the frame. A firing mechanism is provided having a sear, a firing pin, and a hammer with a cocked notch. A double action trigger assembly is provided having a drawbar mounted internally to the frame. The drawbar operates to rotate the hammer into a cocked position in which the sear is engaged with the cocked notch on the hammer. The drawbar further operates to disengage the sear from the hammer, thereby releasing the hammer such that the hammer spring acts on the hammer. This causes the hammer to strike the firing pin to initiate a chambered round. To prevent the hammer from inadvertently initiating the round, a safety device is provided having a grip slidably mounted in the frame. The grip is moveable from a safe position, where the safety device prevents the hammer from initiating a round, to a firing position.

In still another aspect, the invention is directed to a semi automatic handgun comprising a frame. A slide is mounted on the frame such that the slide is longitudinally movable along the frame. A barrel is connected to the frame by a pivot and link, such that the barrel is movable longitudinally and vertically on the frame. A firing mechanism is provided having a sear, a hammer, and a firing pin, the hammer including a cocked notch. There is provided a means for cocking and releasing the hammer to initiate a chambered round, the cocking and releasing means being mounted internally to the frame.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DETAILED DESCRIPTION

Reference will now be made in detail to the presently preferred embodiment of the invention, an example of which is illustrated in the accompanying drawings. Wherever possible, the same reference numbers will be used throughout the drawings to refer to the same or like parts.

In accordance with the present invention, an improvement to a model 1911A1 handgun is provided. The 1911A1 model handgun is disclosed in U.S. Pat. No. 984,519, which is hereby incorporated by reference. U.S. Pat. No. 984,519 discloses the overall structure and operation of the 1911A1 model handgun and its disclosure of the basic structural components and operation will not be repeated. A 1911A1 model handgun is shown in FIG. 1 and is designated generally by reference number 30.

Figure 1:
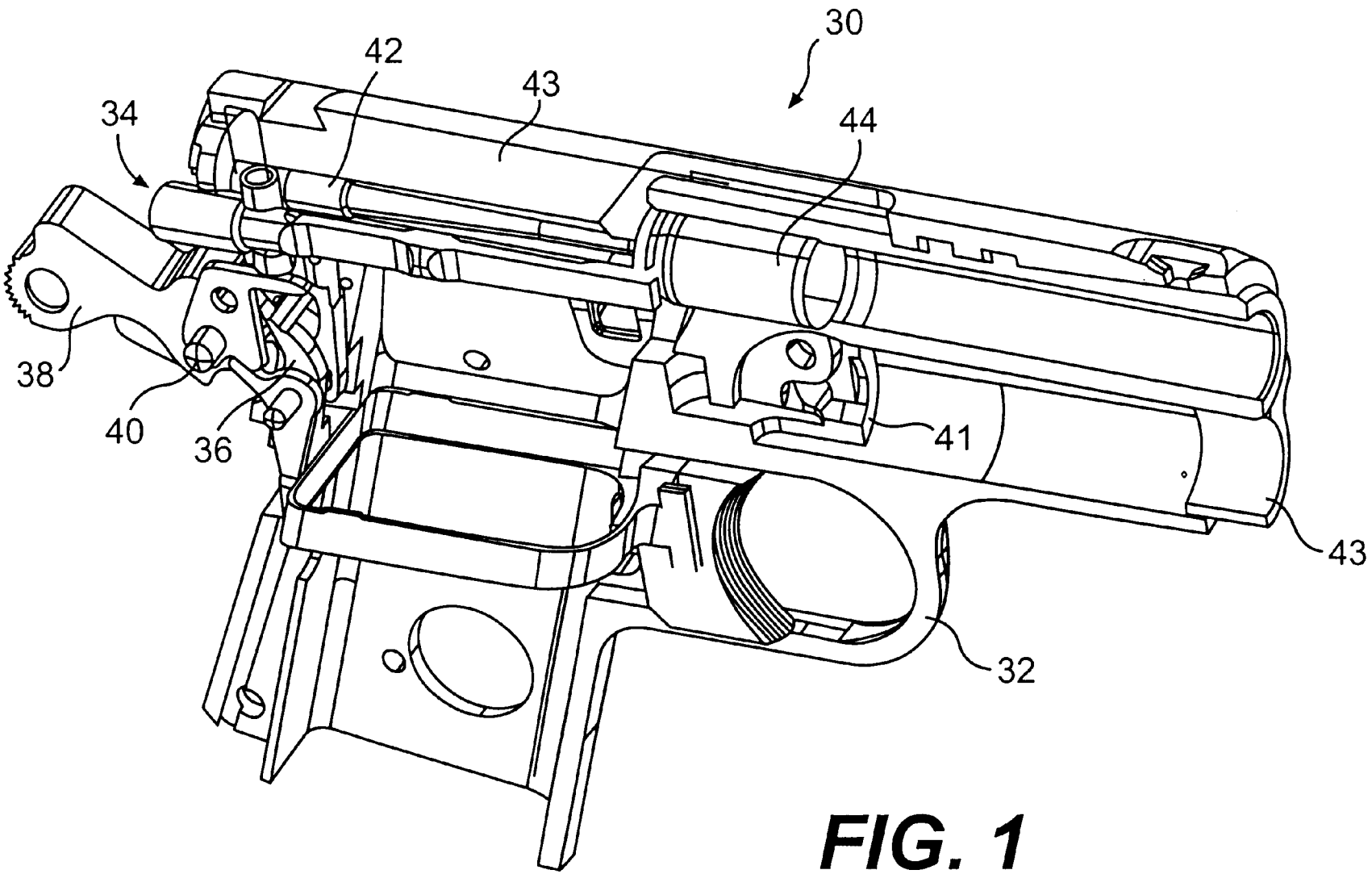
FIG. 1 is a cross sectional side view of a 1911A1 model handgun.

As best illustrated in FIG. 1, the 1911A1 model handgun 30 has a frame 32. In the preferred embodiment of the present invention, the frame 32 is capable of holding a high-capacity magazine. The structure and operation of the frame and high-capacity magazine are disclosed in U.S. Pat. No. 4,862,618, which is hereby incorporated by reference. While the present embodiment utilizes the high capacity magazine, it is contemplated that a standard magazine, as disclosed in U.S. Pat. No. 984,519, could also be used. It is also contemplated that the present invention applies to both conventional and double action only handguns.

Figure 3:
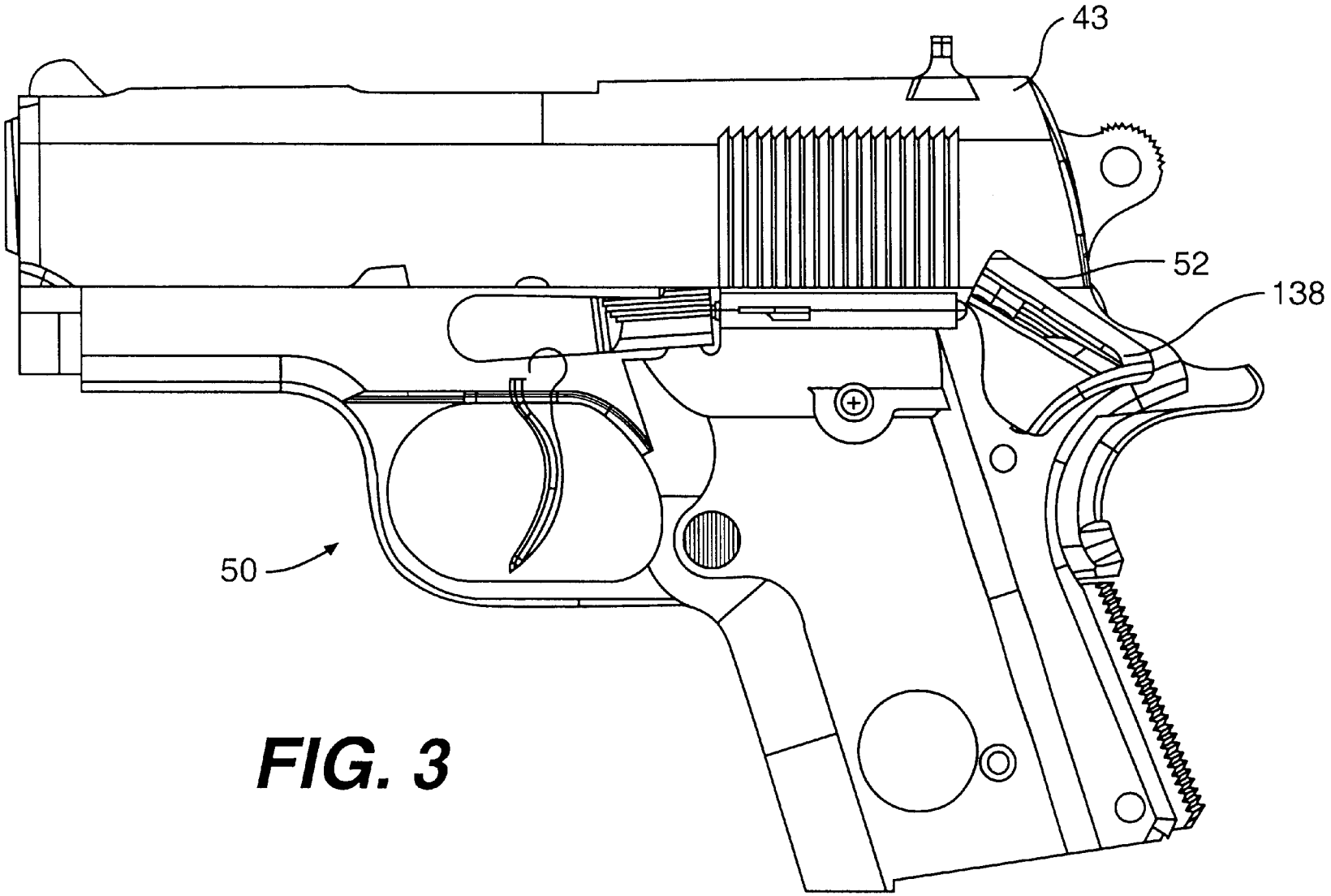
FIG. 3 is a side pictorial view of the handgun of the present invention.

As best illustrated in FIG. 1 the 1911A1 model handgun has a slide 43 mounted on frame 32. The slide 43 moves longitudinally along the frame 32 from a forward position to a rearward position. The rearward position of the slide 43 determined by slide stop 41 in the frame 32. As shown in FIG. 3, slide 43 includes a notch 52 positioned on the rear of the slide.

As also illustrated in FIG. 1, the 1911A1 model handgun 30 has a firing assembly 34. The firing assembly 34 includes a sear 36 that engages and holds a hammer 38. The hammer 38 is acted upon by a hammer spring (not shown), that acts to rotate the hammer 38 about a hammer pin 40 into contact with a firing pin 42. The hammer 38 causes the firing pin 42 to slide forward to strike and initiate a chambered round 44.

Figure 2A:
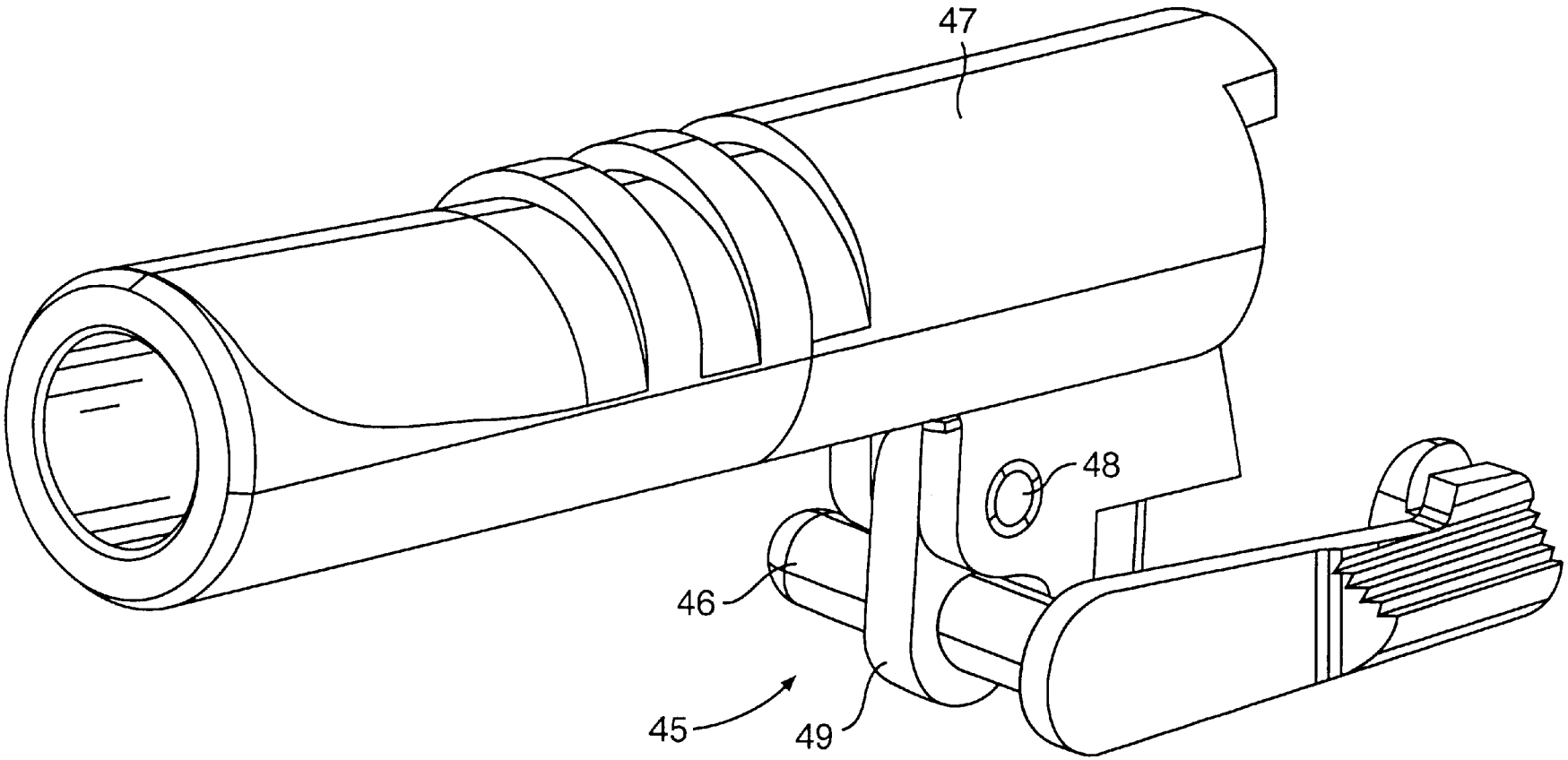
FIG. 2*a* is a pictorial view of the pivoting barrel of the present invention.
Figure 2B:
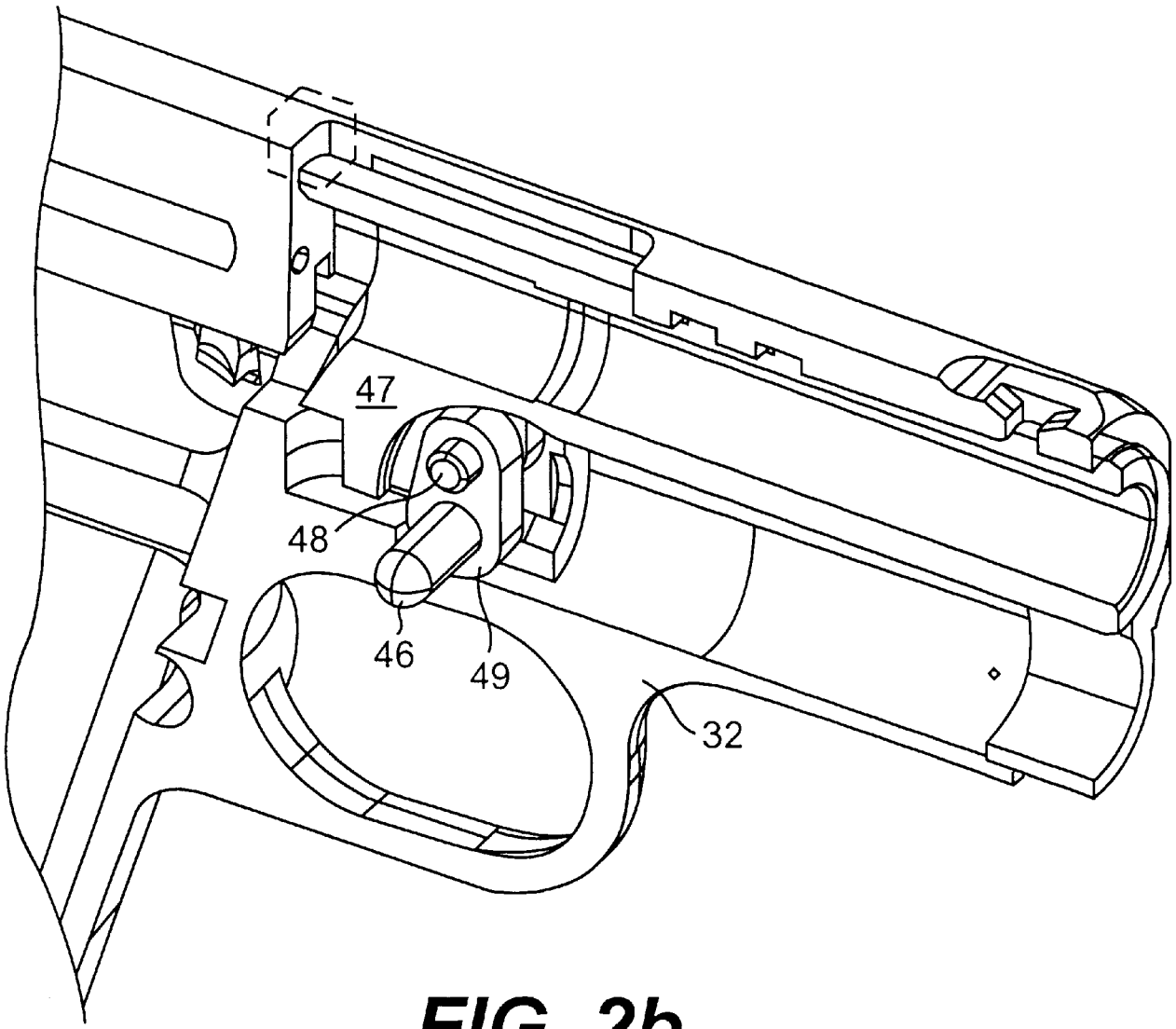
FIG. 2*b* is side pictorial view of the pivoting barrel of FIG. 2*a* positioned on the frame.
Figure 2C:
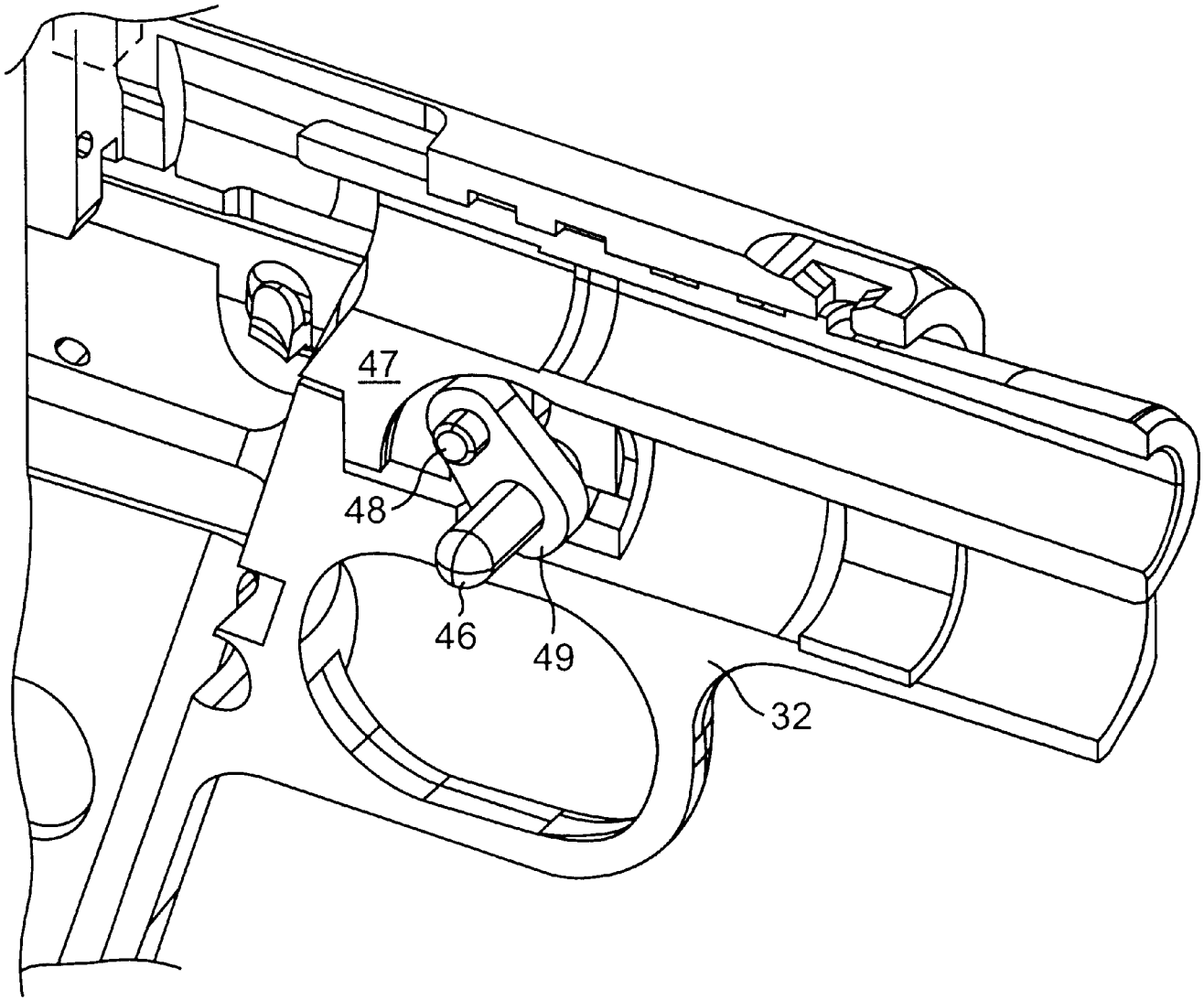
FIG. 2*c* is a side pictorial view of the pivoting barrel of FIG. 2*a* illustrating the longitudinal and vertical motion of the barrel.

As best shown in FIG. 2*a*, the 1911A1 model handgun has barrel 47 connected to a pivot and link assembly generally designated as 45. Barrel 47 is connected to link 49 by pin 48. The link 49 is mounted on a second pin 46. FIG. 2*b* illustrates the barrel 47 and link 49 in position on frame 32. As illustrated in FIG. 2*c*, the link 49 pivots around both pins 46 and 48 allowing the barrel 47 to move longitudinally and vertically with respect to the frame 32.

In accordance with the present invention, a double action trigger assembly for the 1911A1 model style handgun is provided. There is provided a means, mounted internally to the frame, for cocking and releasing the hammer to initiate a chambered round. In a presently preferred embodiment, the trigger assembly includes a drawbar mounted internally to the frame. The internal mounting of the drawbar allows the handgun to retain the same profile as the single action 1911A1 model style handgun. Thus, any equipment, such as a holster, for example, that is used with the single action 1911A1 model style handgun may also be used with the handgun of the present invention. The internal mounting also results in a reliable and low maintenance handgun.

The presently preferred embodiment of the present invention is shown in FIG. 3 and is designated generally by reference number 50. As embodied herein and referring to FIG. 4, the improvement comprises a double action trigger assembly designated generally as 60. The trigger assembly 60 includes a trigger 76 and a drawbar 62. The trigger 76 is mounted on a trigger pin 80 connected to the frame 88. The upper end of the trigger 76 has a pin 100 that engages an opening 101 the drawbar 62.

Figure 4:
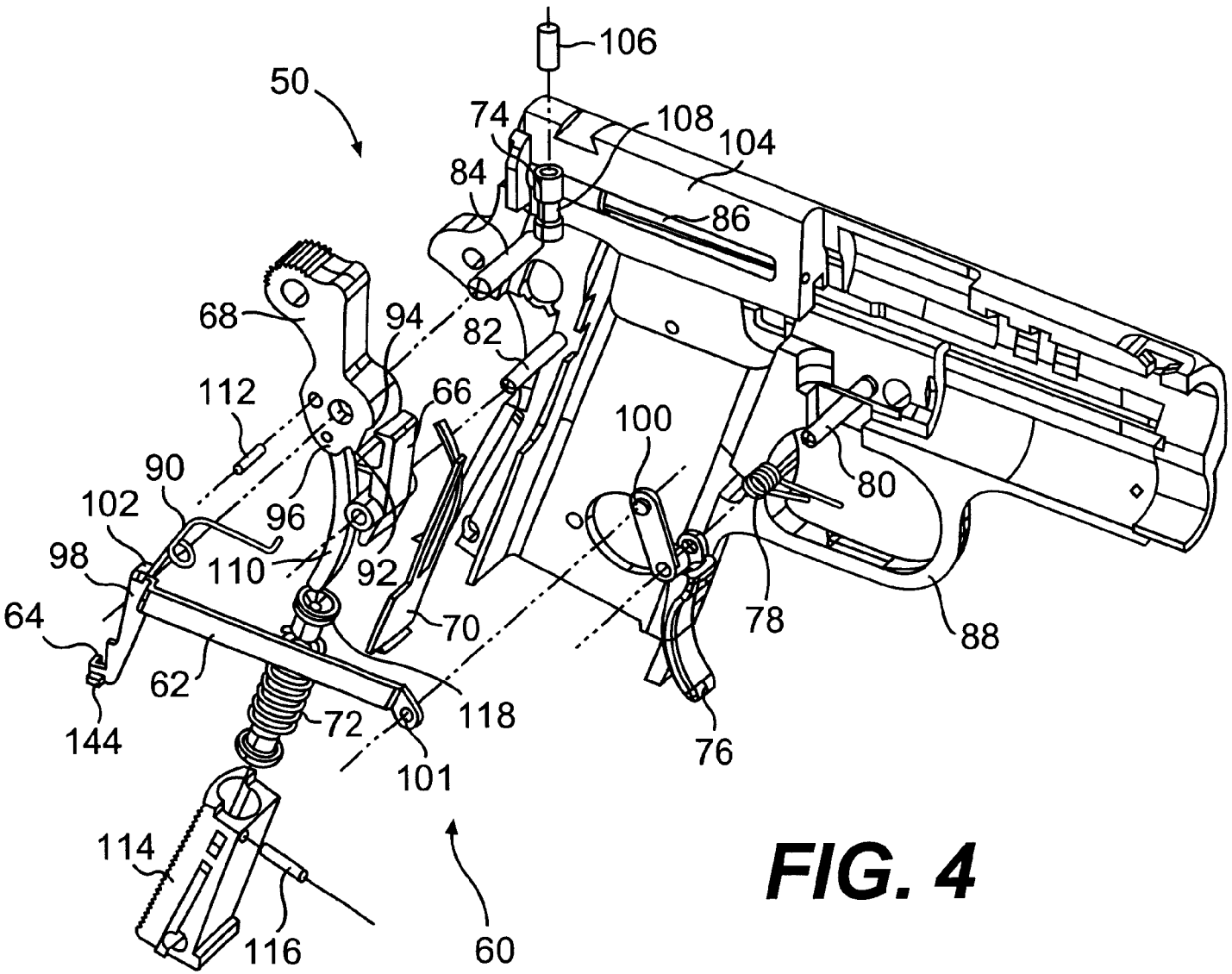
FIG. 4 is an exploded view of the handgun of the present invention.

As shown in FIG. 4, the drawbar 62 has a rear leg 98 that extends downwardly. The rear leg 98 of the drawbar has two tabs: a positioning tab 102 to guide the motion of the drawbar 62 and a hammer tab 64 to rotate the hammer 68. Both tabs project inwardly from the drawbar 62 towards the hammer 68.

The positioning tab 102 is positioned at the upper end of the rear leg 98. A drawbar spring 90 biases the drawbar 62 upwardly so the positioning tab 102 rests against the underside of the slide 104. As the drawbar 62 moves, the positioning tab 102 slides along the underside of the slide 104.

The hammer tab 64 is positioned at the lower end of the rear leg 98. As best illustrated in, FIG. 5, the hammer tab 64 engages a hook 96 on the hammer 68 to rotat[0085] the hammer 68 rearwardly about the hammer pin 84. The hammer tab 64 also contacts the sear 66 to disengage sear 66 from the hammer 68.

Figure 5:
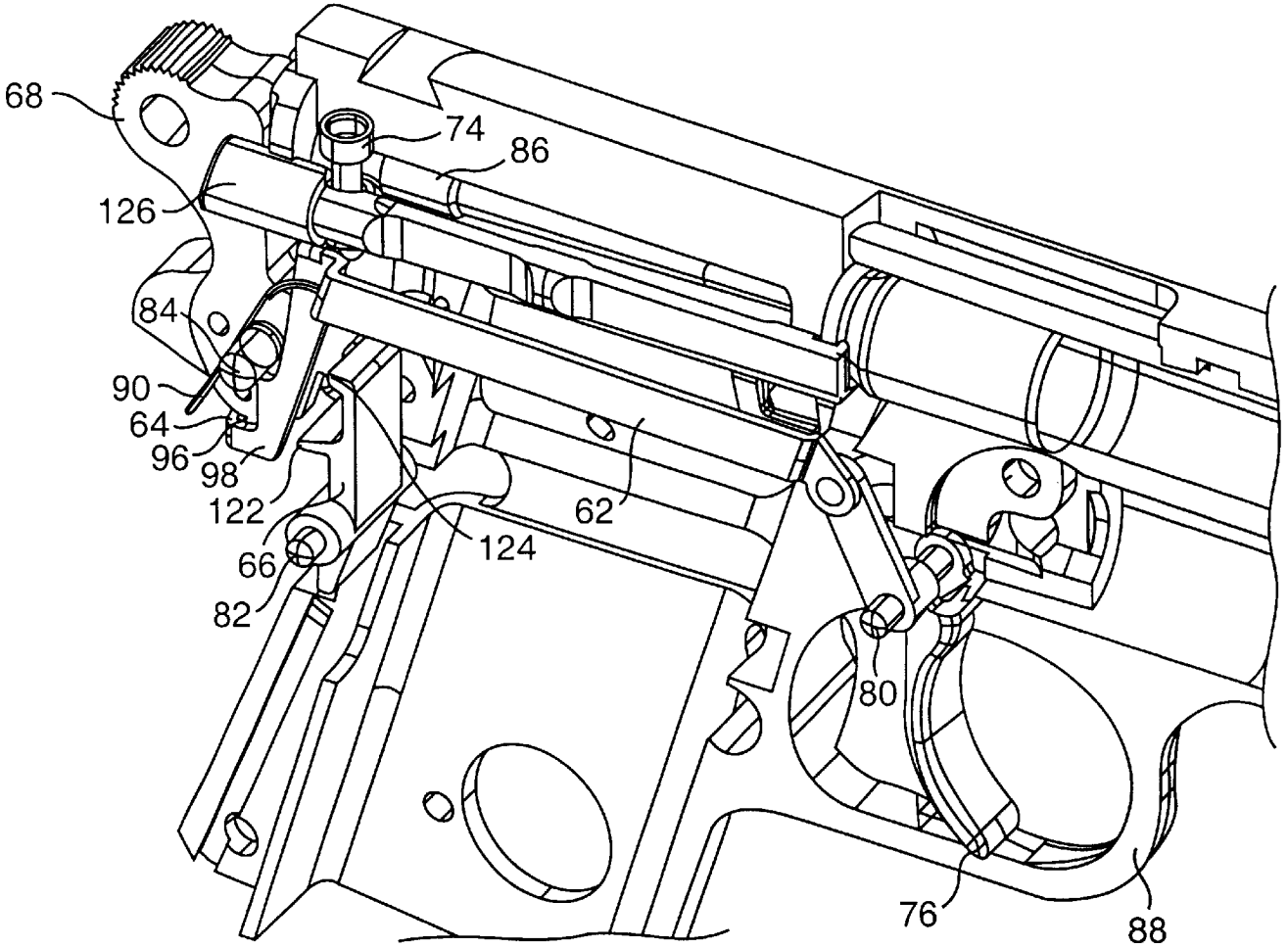
FIG. 5 is a side pictorial view of the double action trigger assembly of the present invention.
Figure 6C:
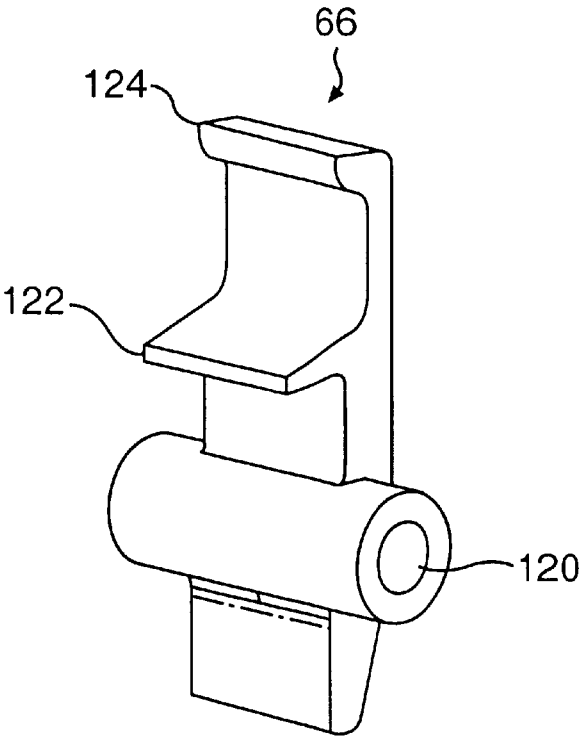
FIG. 6*c* is a side pictorial view of the sear of FIG. 6*a;*
Figure 6B:
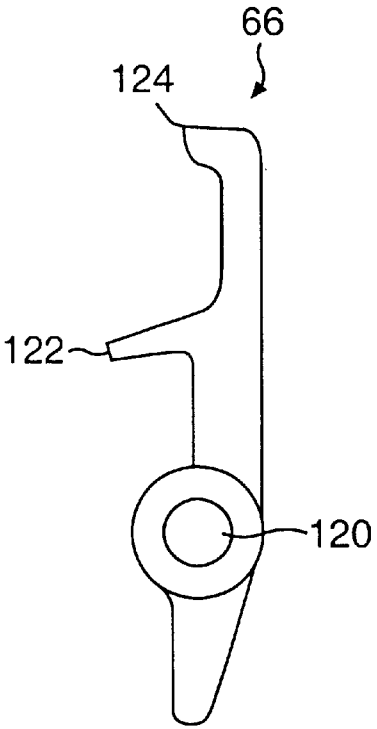
FIG. 6*b* is a side view of the sear of FIG. 6*a;*
Figure 6A:
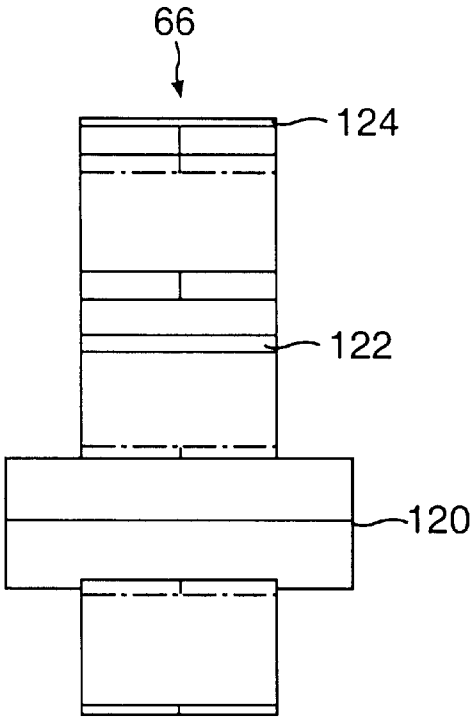
FIG. 6*a* is a front view of the sear of the present invention.
Figure 7C:
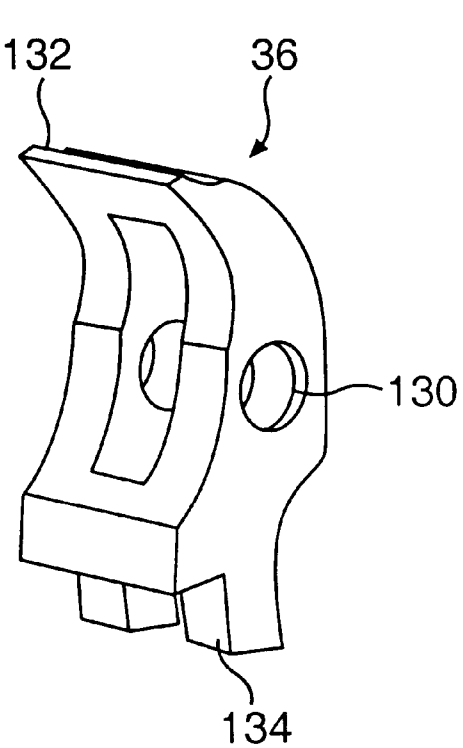
FIG. 7*c* is a side pictorial view of the sear of FIG. 7*a;*
Figure 7B:
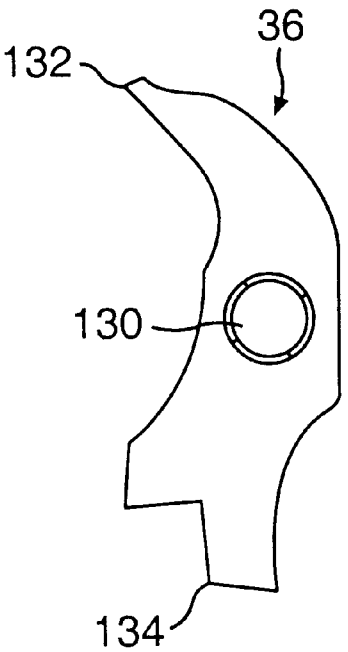
FIG. 7*b* is a side view of the sear of FIG. 7*a;*
Figure 7A:
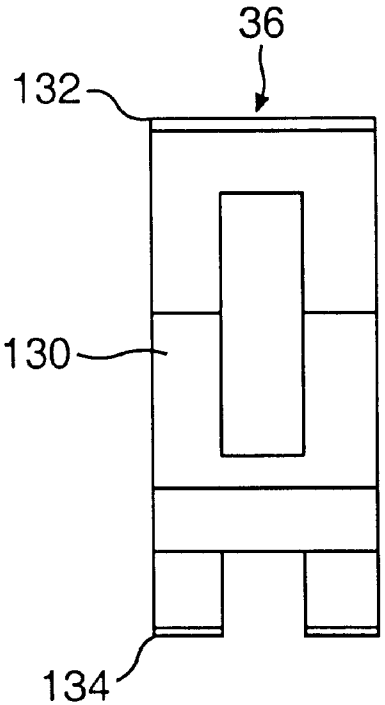
FIG. 7*a* is a front view of a sear from a model 1911A1 handgun.

As illustrated in FIG. 5, the sear 66 is positioned adjacent to the hammer 68. As shown in FIGS. 6*a*–6*c*, the sear 66 has a drawbar contact 122 and a hammer contact 124. Both contacts 122 and 124 are positioned on the same side of the pivot point 120. As illustrated in FIGS. 7*a*–7*c*, the sear 36 of the previous 1911A1 model handgun has a hammer contact 132 and a trigger contact 134 on opposite sides of the pivot point 130.

Figure 9:
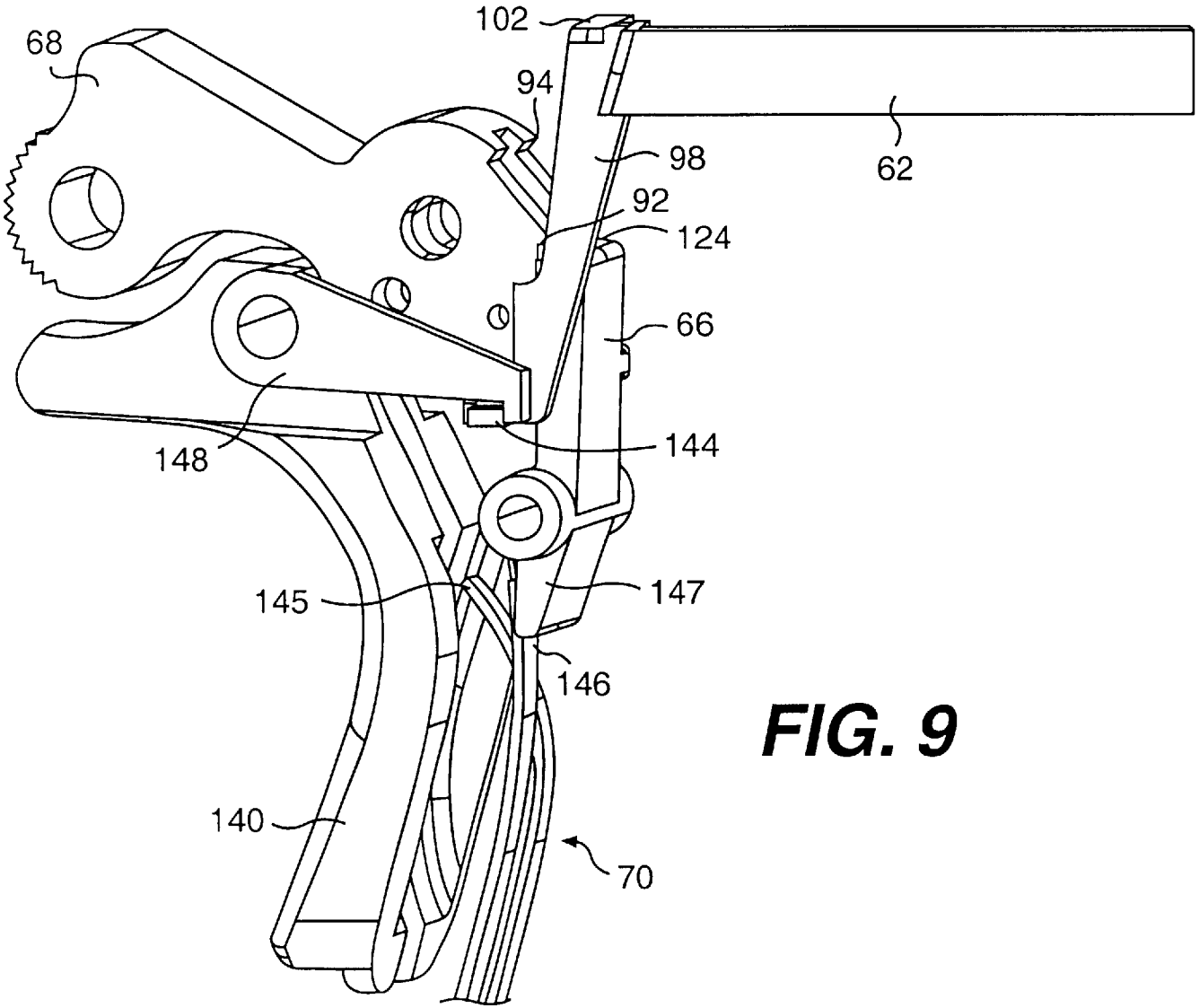
FIG. 9 is a pictorial view of the safety device of the present invention.

As best shown in FIG. 5, the sear 66 of the present invention is mounted on a sear pin 82. As illustrated in FIG. 9, sear spring 70 acts on the sear 66 to rotate the sear 66 into contact with the hammer 68. The sear spring 70 is preferably a leaf spring having two ends 145 and 146. The end 146 acts against a lower paddle 147 of the sear 66. The action of the sear spring 70 causes the hammer contact 124 of sear 66 to engage the hammer 68. The hammer contact 124 engages the hammer 68 at either a half-cocked notch 94 or a cocked notch 92 on the hammer 68.

As best shown in FIG. 4, a hammer spring 72 acts on the hammer 68 to rotate the hammer 68 into engagement with the sear 66. The hammer 68 is connected to the hammer spring 72 with a connecting member 110. The connecting member 110 is connected to the hammer with a pin 112 and engages a plug 118 in the hammer spring 72. The hammer spring 72 is contained in handle 114 by a pin 116.

In accordance with the present invention, a firing pin plunger is provided to lock the firing pin in place. A plunger spring biases the firing pin plunger against the drawbar.

As embodied herein and referring to FIG. 5, the firing pin plunger 74 engages firing pin 86 and extractor 126 to lock the firing pin 86 and extractor 126 in place. As illustrated in FIG. 4, a firing pin plunger spring 106 biases the firing pin plunger 74 downwardly against drawbar 62 which is biased upwardly by drawbar spring 90. The force of the firing pin plunger spring 106 is less than that of the drawbar spring 90.

As illustrated in FIG. 4, the firing pin plunger has a narrow middle section 108. When the drawbar 62 moves out from under the firing pin plunger 74, the plunger spring 106 acts on the firing pin plunger 74 to move the firing pin plunger 74 downwardly and align the narrow middle section 108 with the firing pin 86 and extractor 126. In this manner, the firing pin plunger 74 is disengaged from the firing pin 86 and extractor 126 and the firing pin 86 and extractor 126 are free to move. The bottom of the firing pin plunger 74 is rounded so that when the drawbar moves back under the firing pin plunger 74, the firing pin plunger 74 is forced upwardly by the drawbar 62 and re-engages the firing pin 86, locking the firing pin in place.

In accordance with the present invention, a grip safety mechanism is provided to prevent accidental firings of the handgun. The safety mechanism is slidably mounted in the frame and operates to prevent the handgun from discharging when the mechanism is in a safe position.

Figure 8:
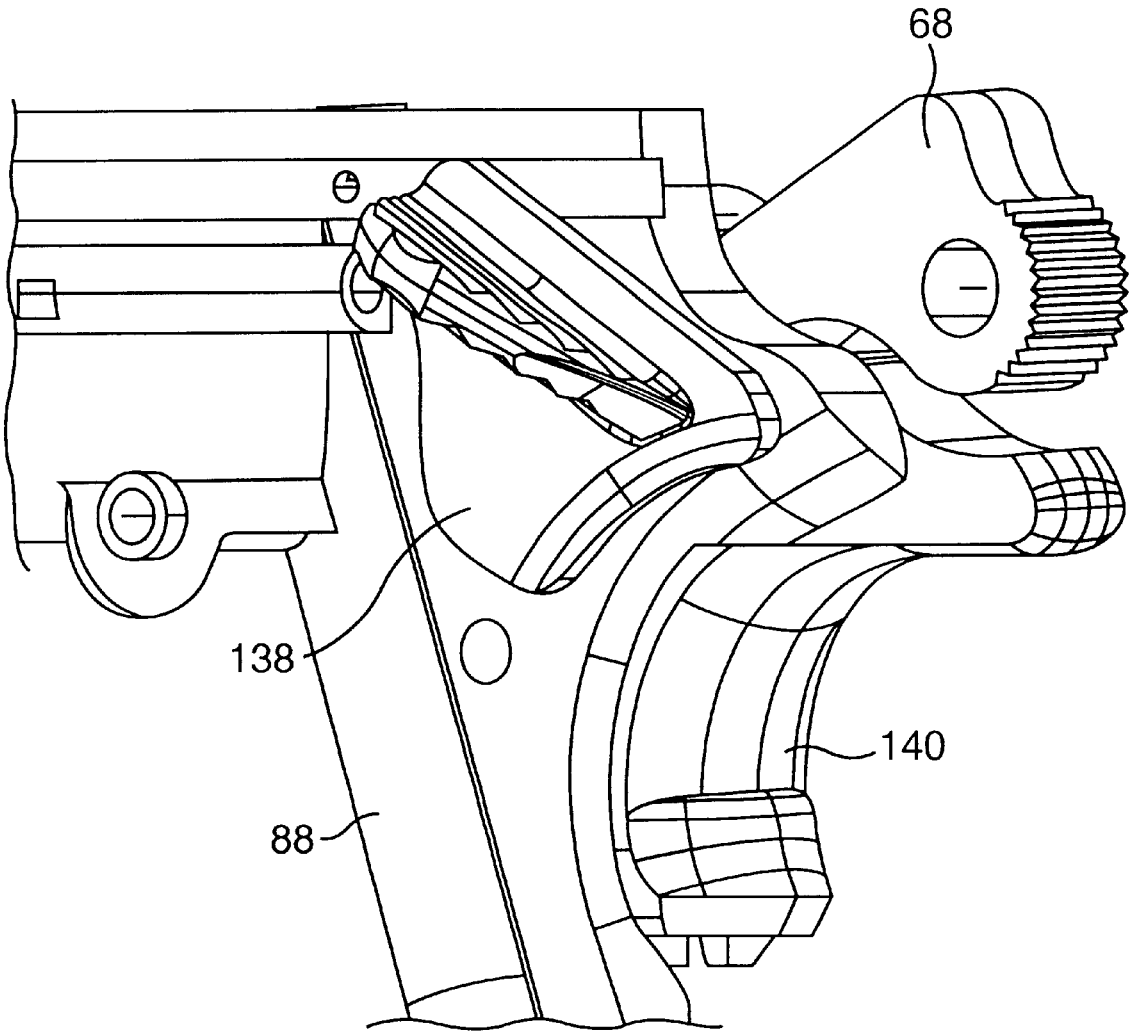
FIG. 8 is a partial pictorial view illustrating the de-cocking lever and grip safety of the present invention.
Figure 10:
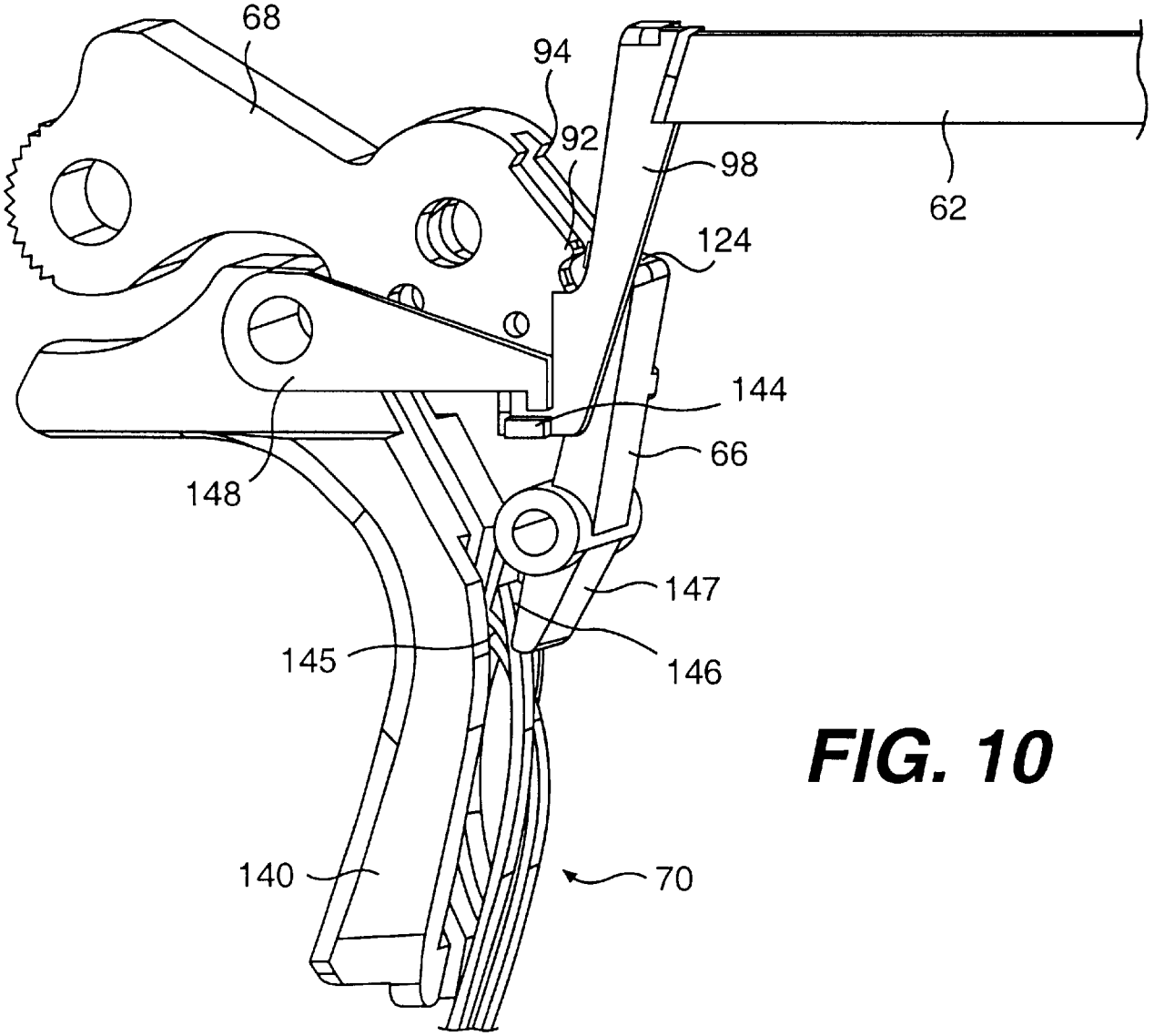
FIG. 10 is a pictorial view of the safety device of FIG. 9, illustrating the firing position.

As embodied herein and best illustrated in FIG. 8, the safety mechanism has a grip 140 slidably mounted on the frame 88. As shown in FIGS. 9 and 10, a catch 148 is connected to the grip 140. The catch 148 abuts safety tab 144 on the rear leg 98 of drawbar 62. The end of the catch 148 projects downwardly and engages the safety tab 144. The end 145 of the sear spring 70 acts on the grip 140 and operates to slide the grip 140 rearwardly to a safe position. The engagement of the catch 148 and the safety tab 144 operates to prevent the drawbar from disengaging the sear 66 from the hammer 68.

Figure 11:
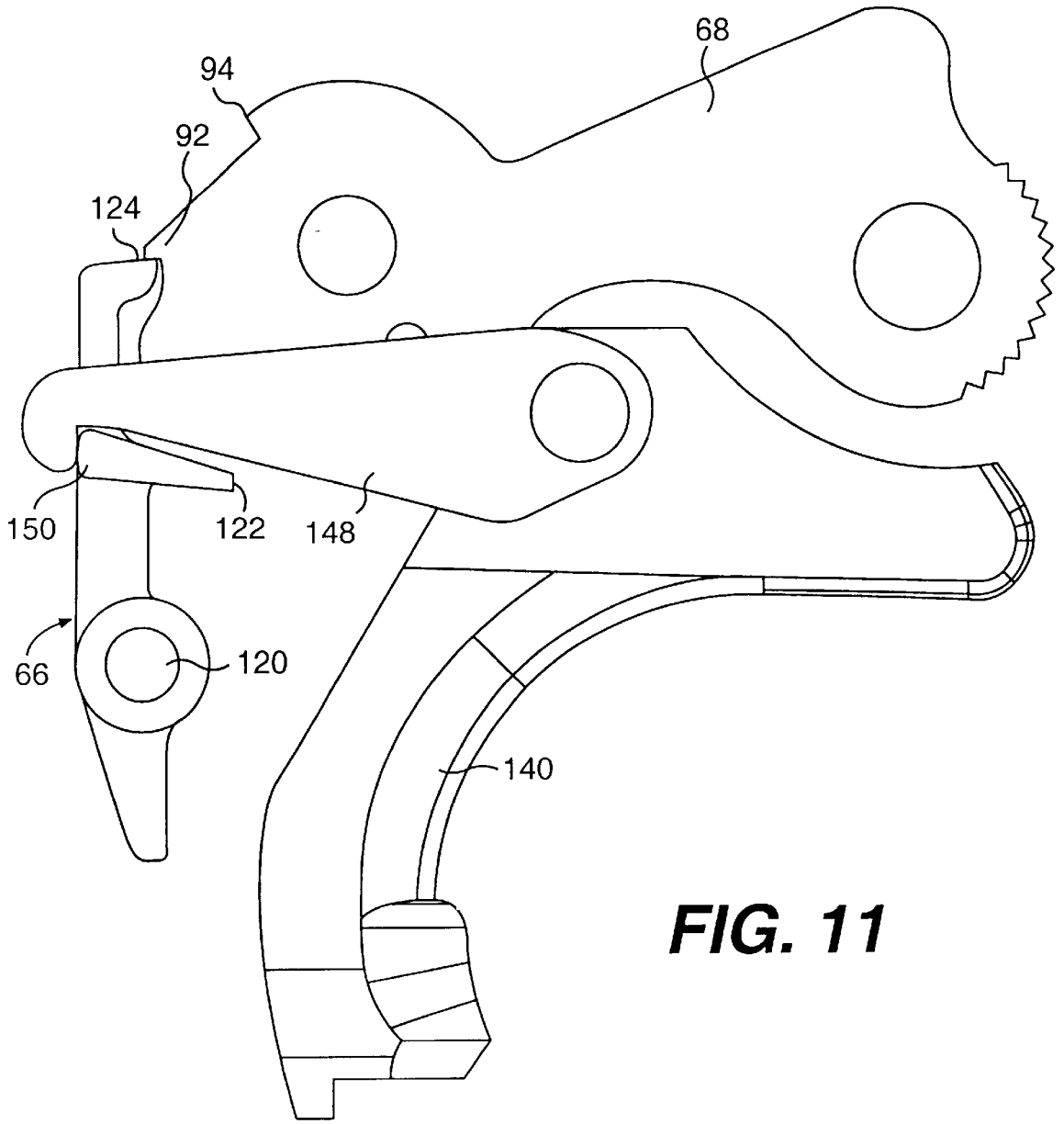
FIG. 11 is a side view of an alternative embodiment of the safety device of the present invention.
Figure 12:
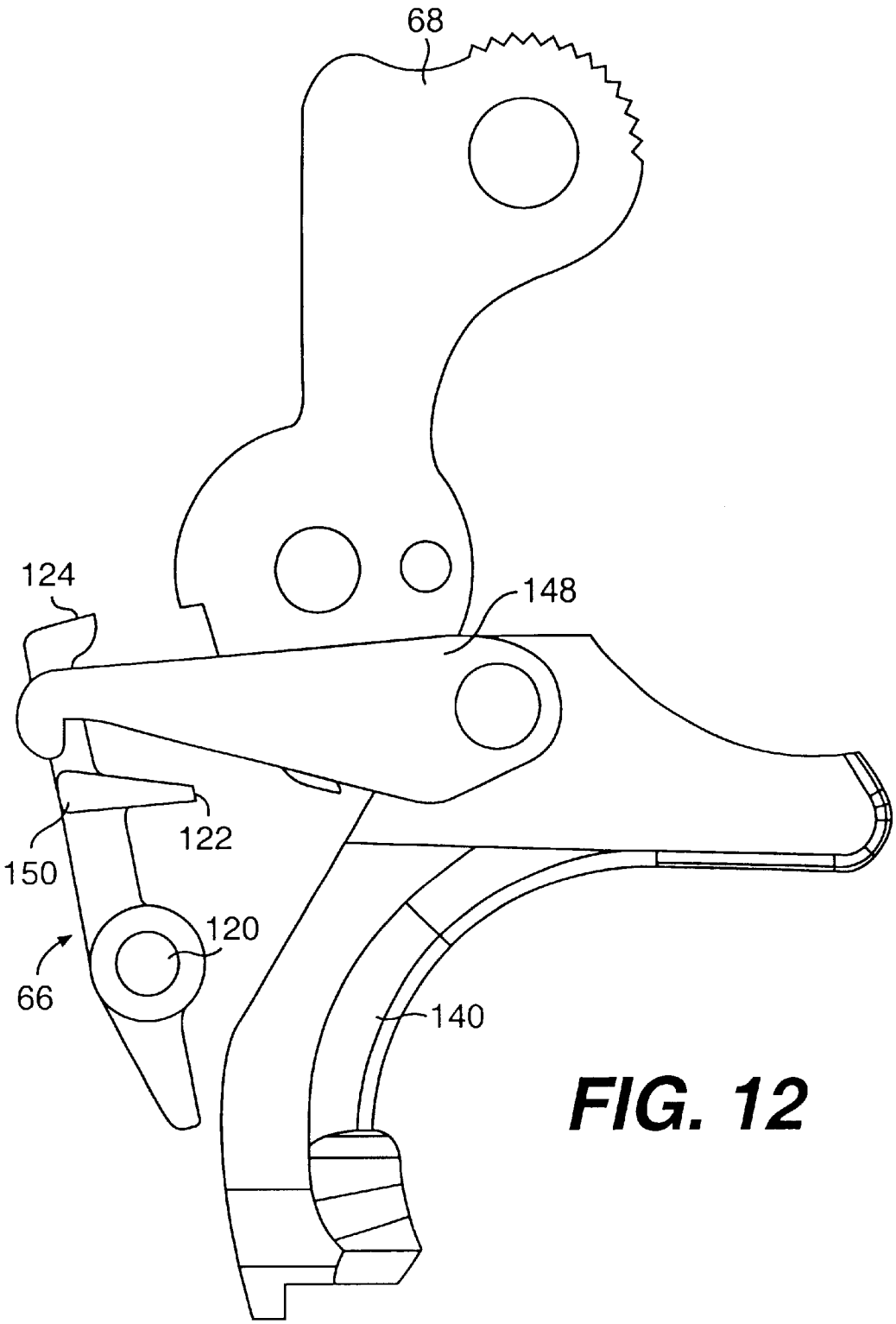
FIG. 12 is a side view of the safety device of FIG. 11.

An alternative embodiment of the safety mechanism is illustrated in FIGS. 11 and 12. In this embodiment and as best shown in FIG. 11, the catch 148 operates to engage a safety tab 150 on the sear 66. When the grip 140 is in the safe position, the catch 148 prevents the sear 66 from rotating out of engagement with the hammer 68. As illustrated in FIG. 12, when the grip is in the firing position, the catch 148 disengages the sear 66 so that the sear 66 may disengage from the hammer 68.

In accordance with the present invention, a de-cocking device is provided to release the hammer from a cocked position to a half-cocked position without initiating a chambered round. When the hammer is in the half-cocked position, the hammer must be re-cocked prior to discharging another round.

Figure 13:
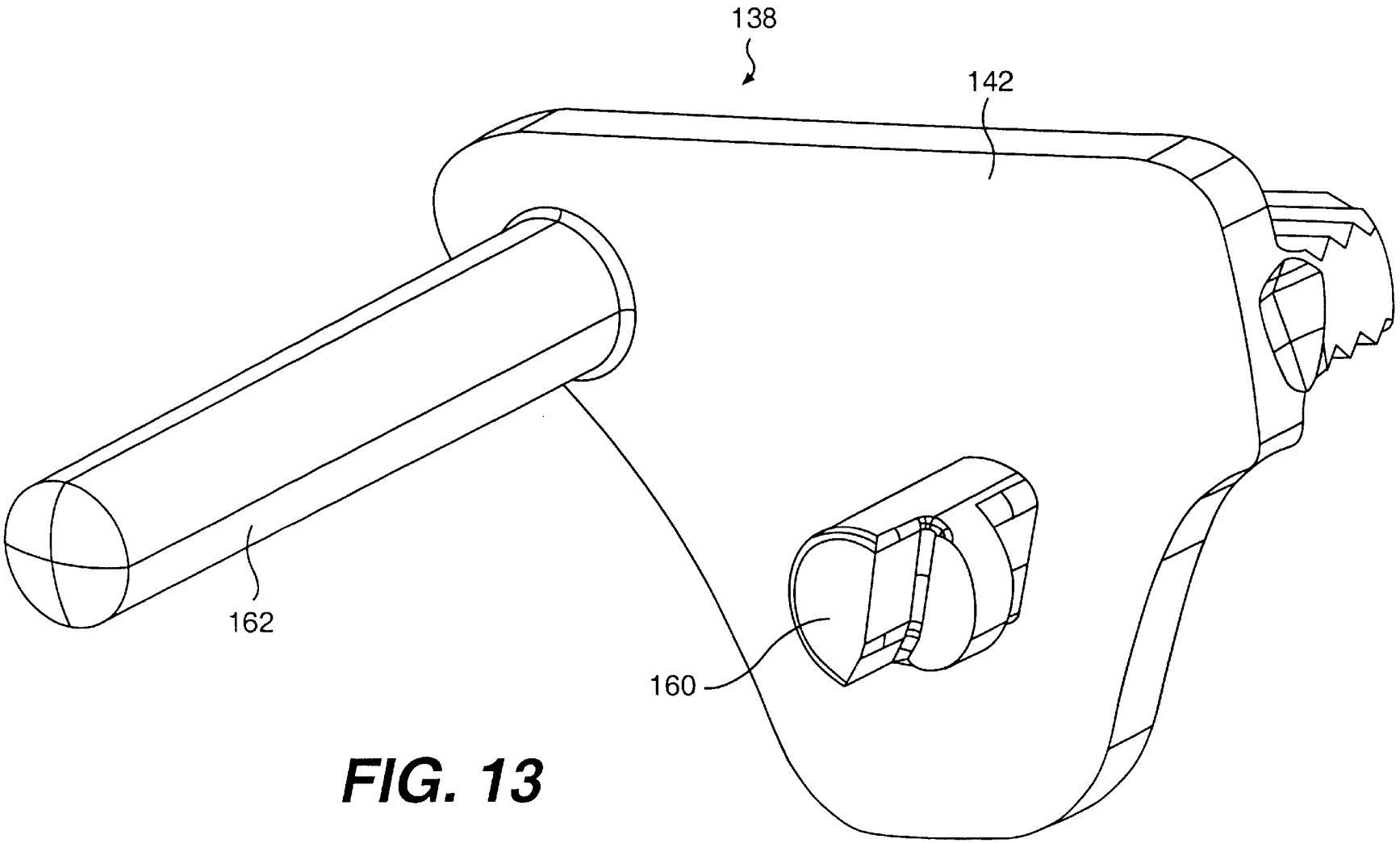
FIG. 13 is a pictorial view of the de-cocking lever of the present invention.
Figure 14:
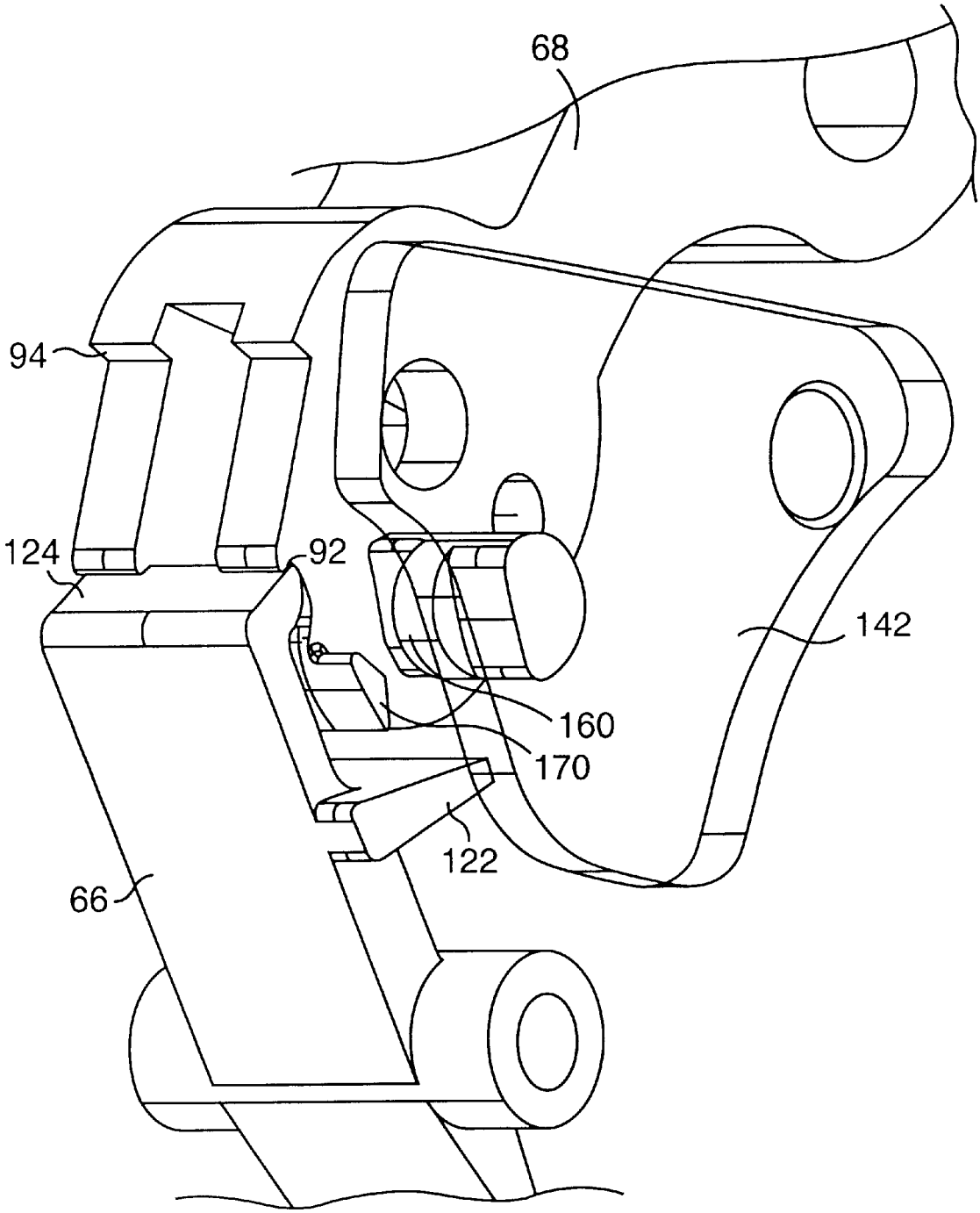
FIG. 14 is a pictorial view of the de-cocking device of the present invention, illustrating the hammer in the cocked position.
Figure 15:
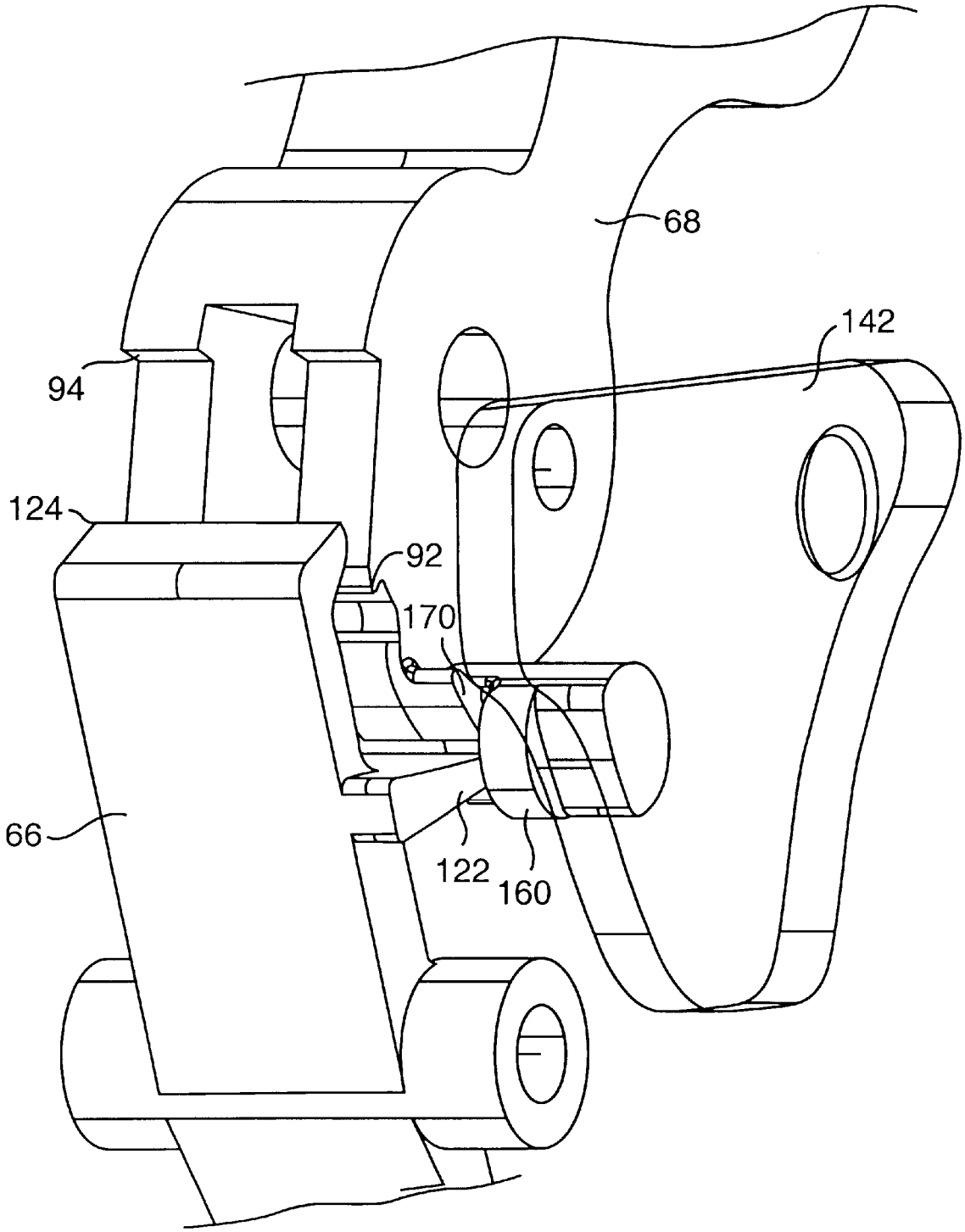
FIG. 15 is a pictorial view of the de-cocking device of FIG. 14, illustrating the disengagement of the sear.
Figure 16:
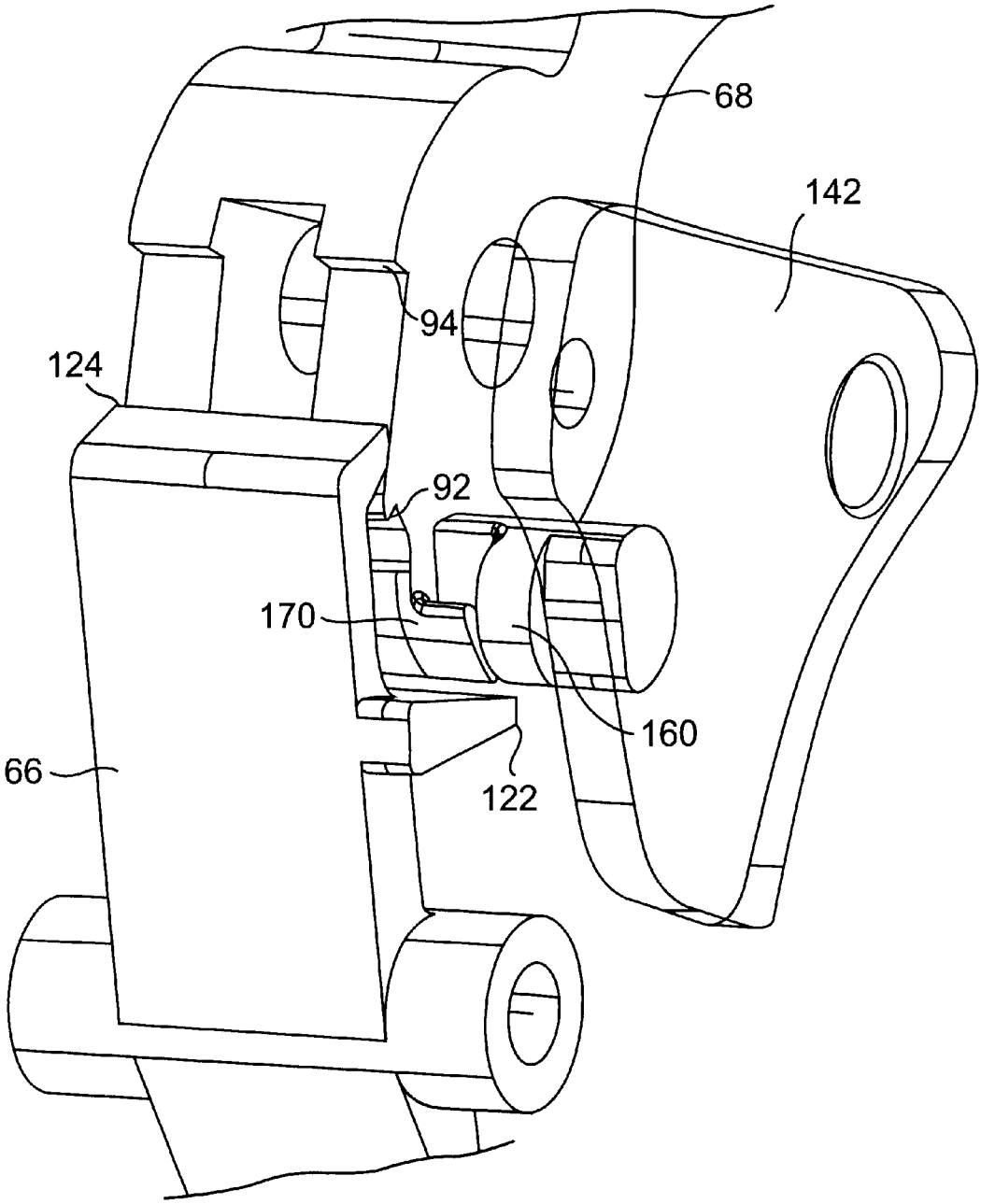
FIG. 16 is a pictorial view of the de-cocking device of FIG. 14, illustrating the half-cocked position.

As embodied herein and best illustrated in FIG. 3 and 4, the de-cocking device 138 is an positioned on the rear of the handgun. Preferably, as shown in FIG. 3, de-cocking device 138 is combined with the conventional thumb safety of the model 1911A1 handgun. As illustrated in FIG. 3, the thumb safety is engageable with notch 52 in slide 43 to prevent the slide from moving relative to the frame. Referring to FIG. 13, the de-cocking device 138 comprises a lever arm 142 having a boss 160. The lever arm 142 is fixably connected to a pin 162 that rotates within the frame. As illustrated in FIGS. 14, 15, and 16, the boss 160 on the de-cocking device is positioned to engage both a boss 170 on the hammer 68 and the drawbar contact 122 on the sear 66. FIG. 14 illustrates the hammer 68 in the cocked position. FIG. 15 shows the engagement of the de-cocking boss 160 and the hammer boss 170 when the sear 66 has disengaged the cocked notch 92 of the hammer 68. FIG. 16 illustrates the sear 66 in position to engage the half-cocked notch 94 of the hammer 68.

Figure 17:
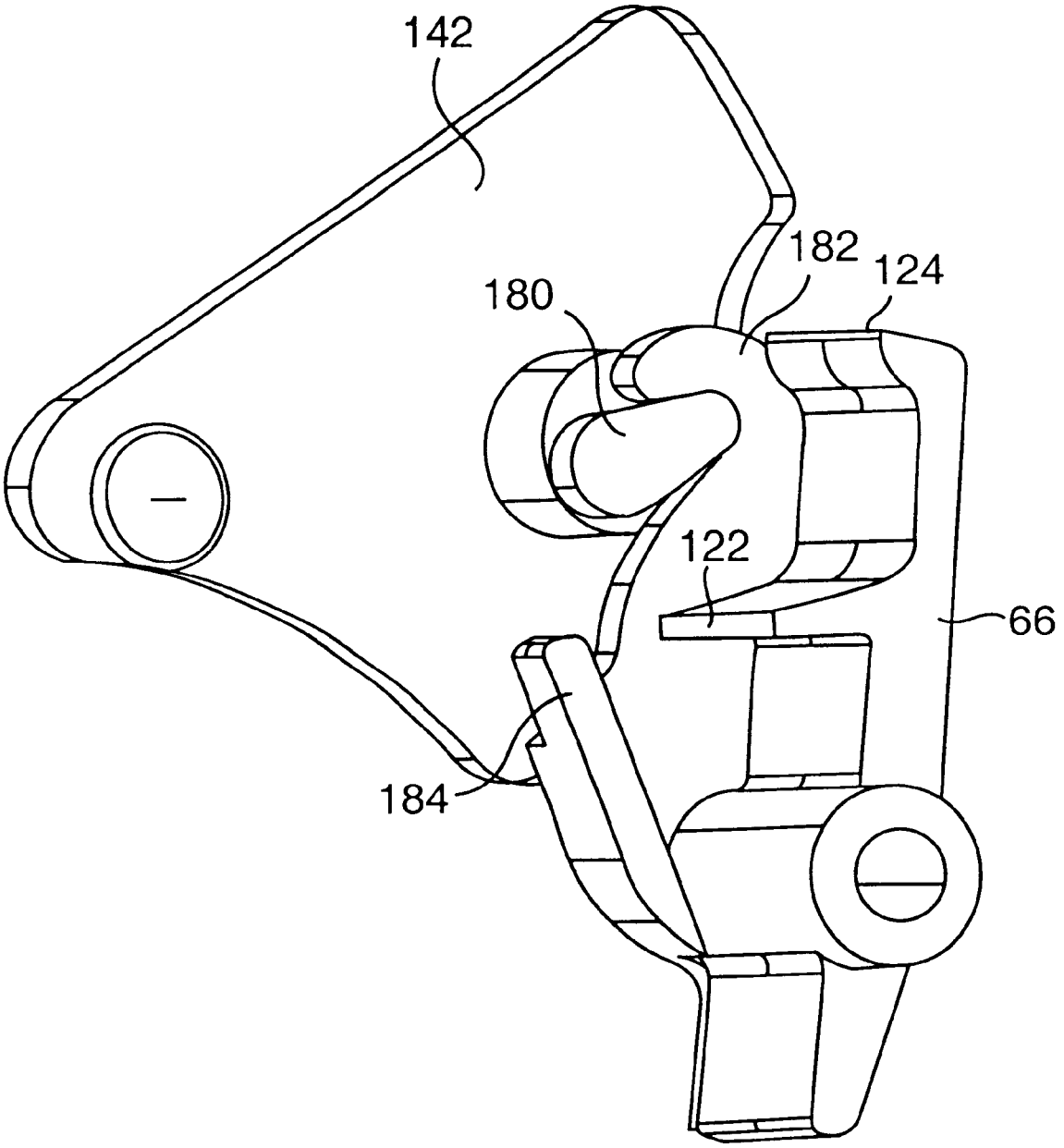
FIG. 17 is a pictorial view of an alternative embodiment of the de-cocking device of the present invention.
Figure 18:
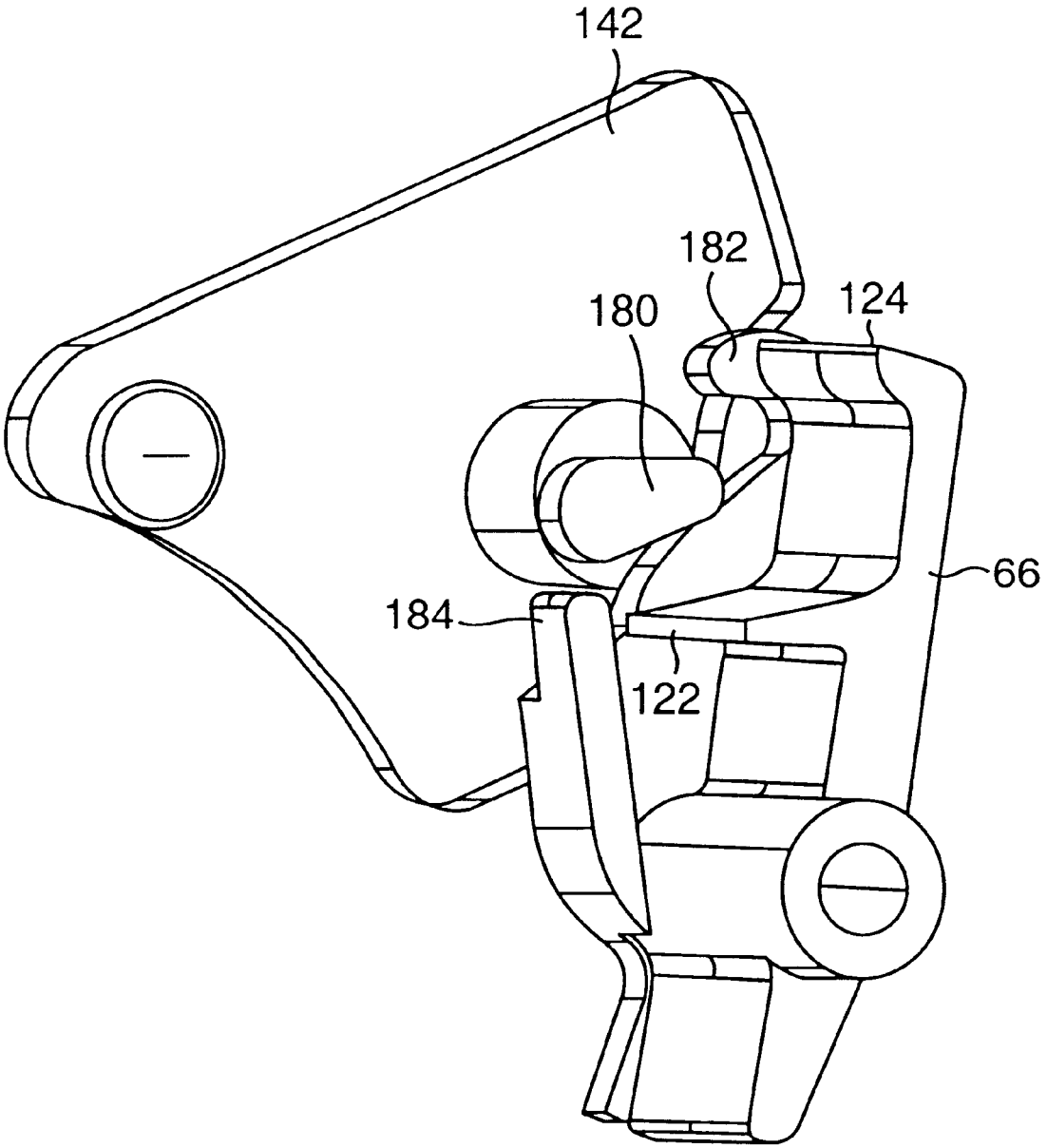
FIG. 18 is a pictorial view of the de-cocking device of FIG. 17, illustrating the rotation of the sear.
Figure 19:
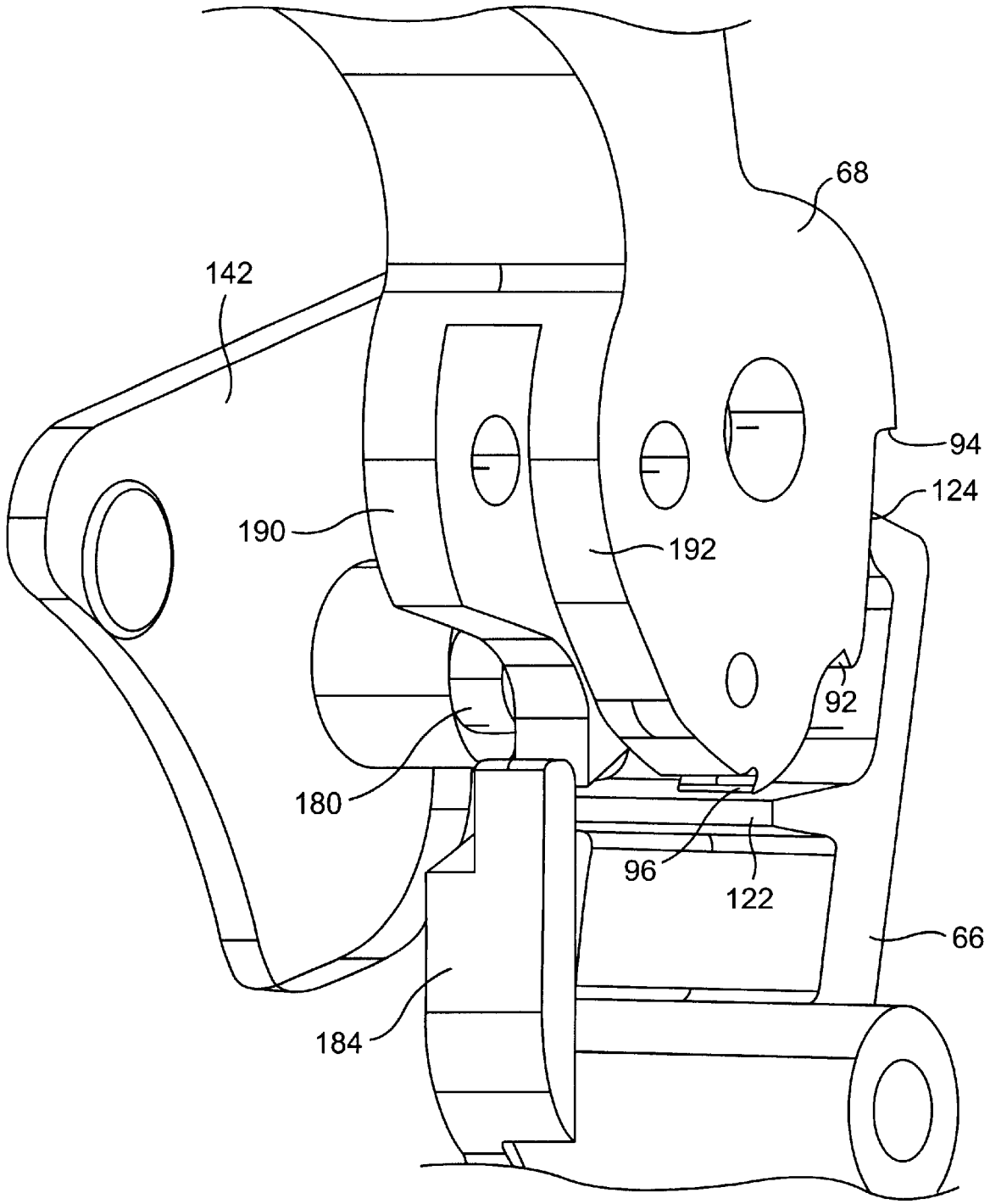
FIG. 19 is a pictorial view of the de-cocking device of FIG. 17 and the hammer of the present invention.

An alternative embodiment of the de-cocking device is illustrated in FIGS. 17, 18, and 19. In this embodiment and as best shown in FIG. 17, the boss 180 on the de-cocking lever arm 142 engages a cam 182 on a hammer support member 184. The hammer support member 184 is mounted adjacent to the sear 66 and both the hammer support member 184 and the sear 66 rotate about the sear pin (not shown). As shown in FIG. 18, the hammer support member 184 engages the sear 66 so that a rotation of the hammer support member 184 causes a corresponding rotation in the sear 66.

As illustrated in FIG. 19, the hammer 68 has two engagement surfaces 190 and 192. One engagement surface 192 has the hook 96 that the drawbar (not shown) engages to rotate the hammer 68. The other engagement surface 190 is aligned with the hammer support member 184. The hammer support member 184 engages this engagement surface 190 to support the hammer 68 when the sear 66 is disengaged from the cocked notch 92 of the hammer 68.

Figure 20:
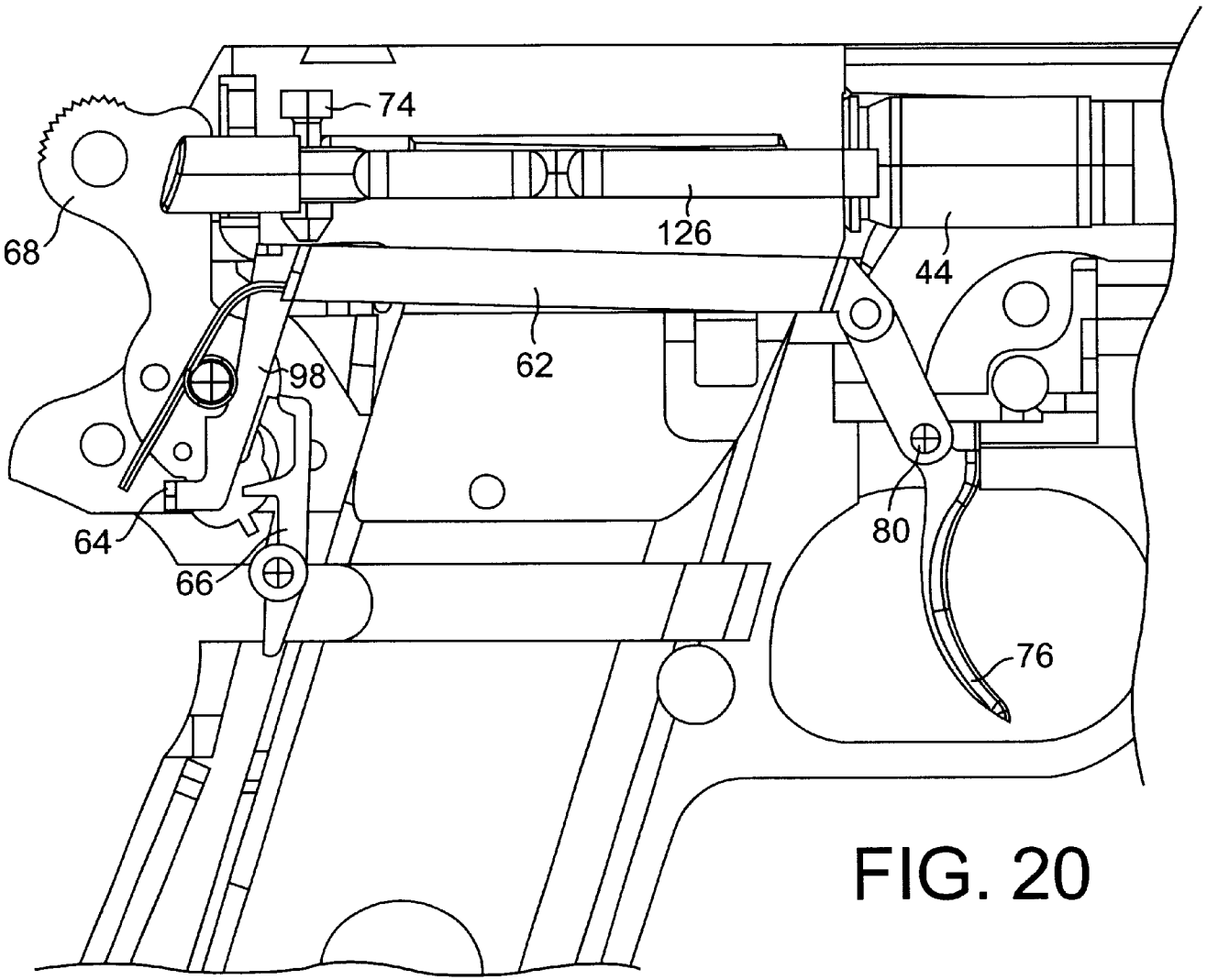
FIG. 20 is a side view of the double action trigger assembly of the present invention.

The operation of the aforementioned device will now be described with reference to the attached drawings. As illustrated in FIG. 20, the operation of the handgun of the present invention begins with the trigger 76 in the full forward position and a round 44 held in the chamber by the extractor 126. In this position, the sear 66 is not engaged with the hammer 68 which rests in an un-cocked position. The firing pin plunger 74 locks the firing pin 86 (referring to FIG. 5) in place.

Figure 21:
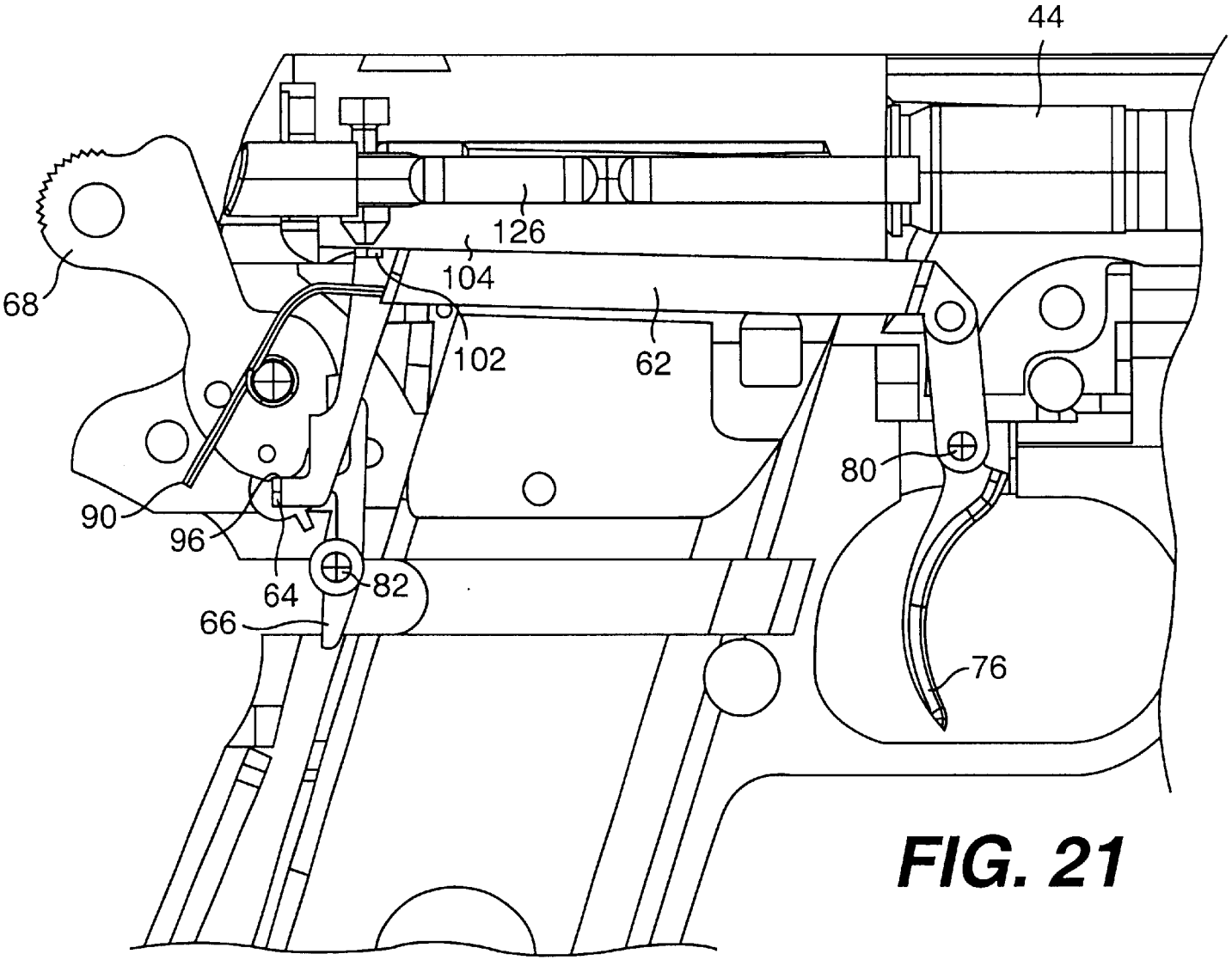
FIG. 21 is a side view of the double action trigger assembly of the present invention, illustrating the rotation of the hammer.
Figure 22:
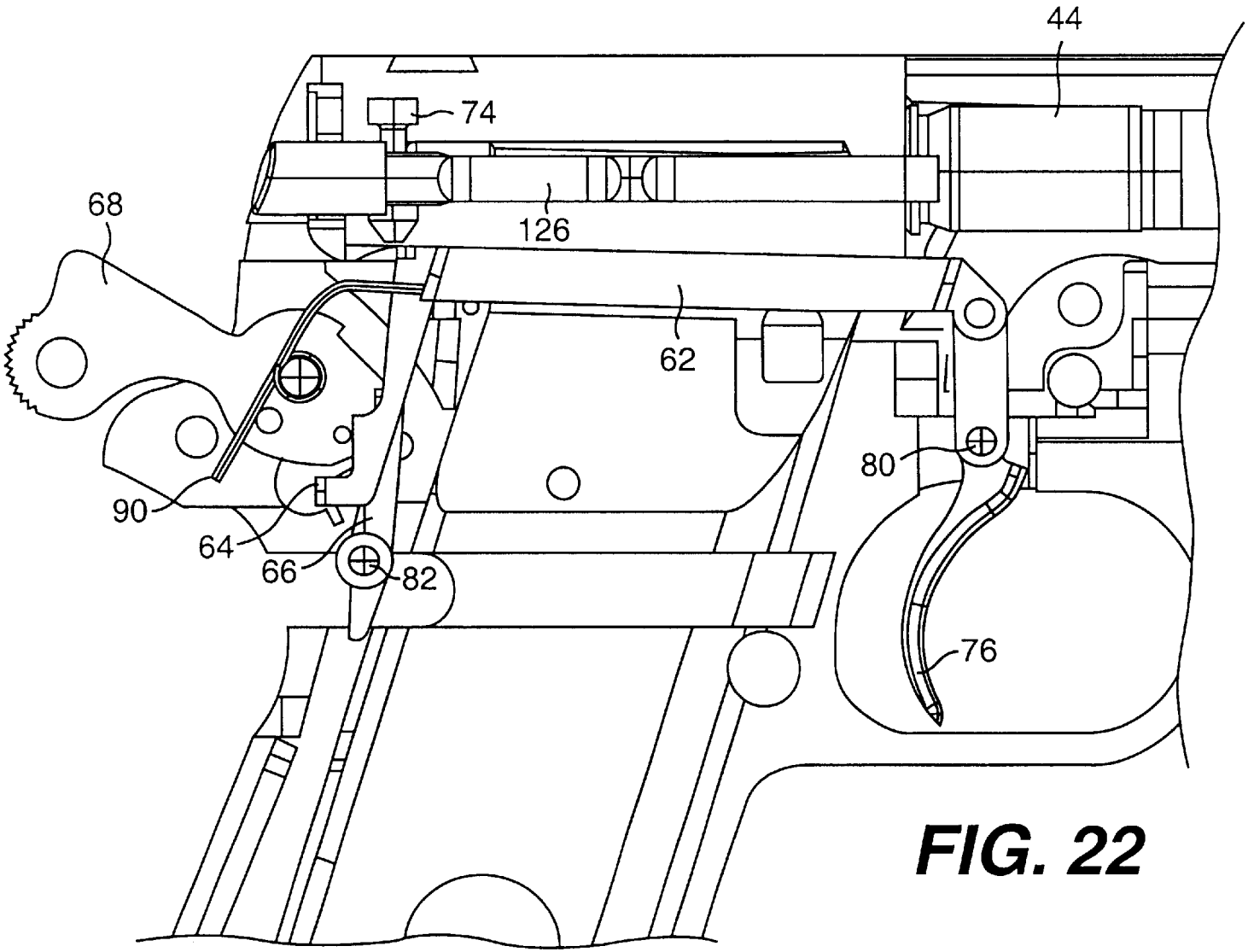
FIG. 22 is a side view of the double action trigger assembly of the present invention, illustrating the cocked position.

As FIG. 21 illustrates, the trigger 76 is pulled rearwardly causing the trigger 76 to pivot about the trigger pin 80. This motion results in the drawbar 62 moving forwardly. The drawbar spring 90 biases the drawbar 62 upwardly so that the positioning tab 102 slides along the underside of the slide 104. The hammer tab 64 engages the hammer hook 96 to rotate the hammer 68 rearwardly. As the hammer 68 rotates, the hammer spring 72 (referring to FIG. 4) is compressed and the sear 66, which is biased by the sear spring 70 (referring to FIG. 4), maintains contact with the surface of the hammer 68. When the hammer 68 has rotated to a certain point, the hammer tab 64 disengages from the hammer hook 96 allowing the hammer 68 to rotate forward until the sear 66 engages the cocked notch 92 on the hammer 68 (as illustrated in FIGS. 9, 14, and 22). The hammer spring 72 (referring to FIG. 5) is now fully compressed.

As the trigger continues its pull, the drawbar 62 moves forward until the hammer tab 64 contacts the drawbar contact 122 (referring to FIGS. 6*a*–6*c*) of the sear 66. This contact causes the sear 66 to rotate about the sear pin 82 and disengage from the cocked notch 92 of the hammer 68. The compressed hammer spring 72 (referring to FIG. 5) then acts on the hammer 68 to rotate the hammer 68 forward to strike the firing pin 86.

Figure 23:
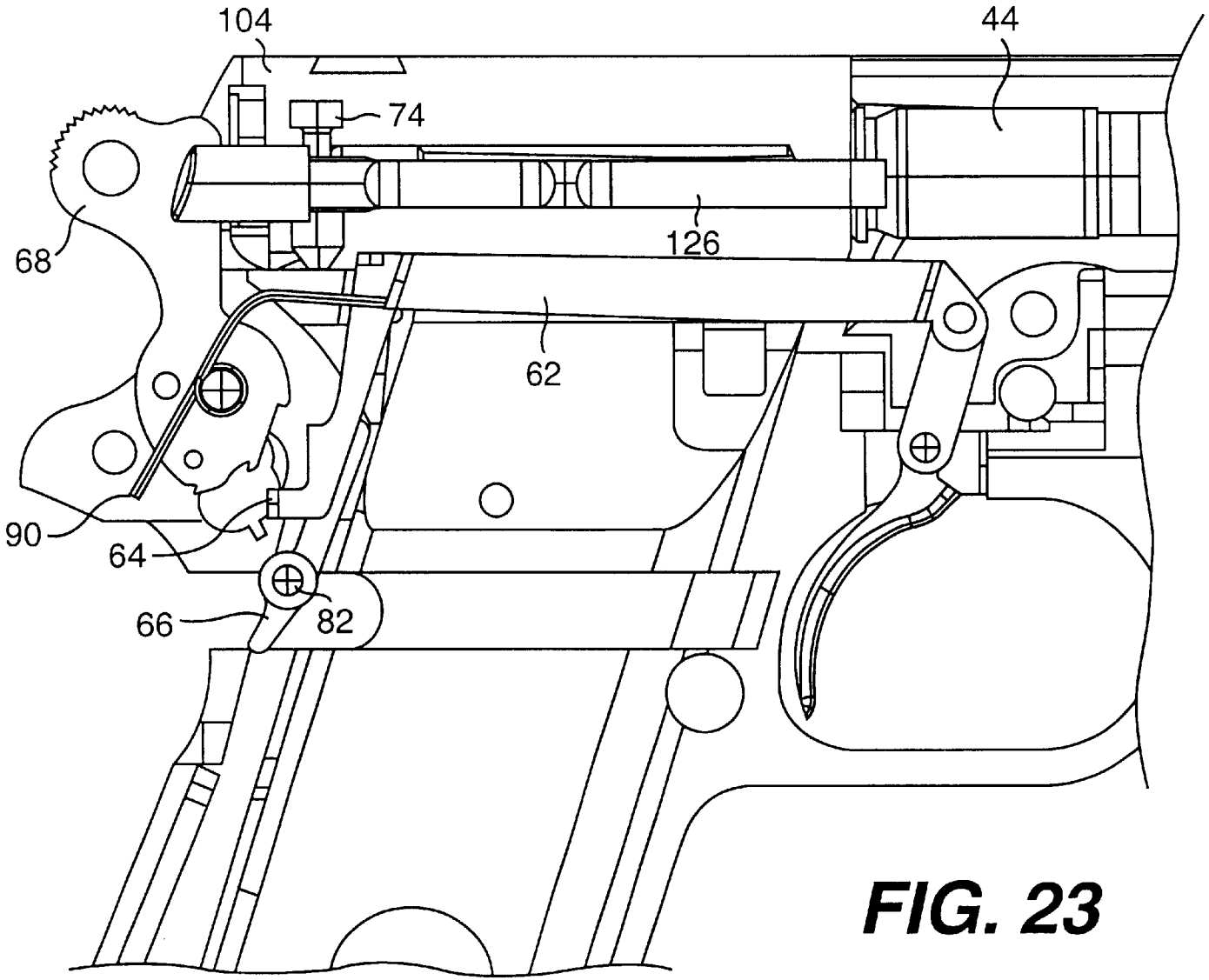
FIG. 23 is a side view of the double action trigger assembly of FIG. 20, illustrating the firing position.

As illustrated in FIG. 23, when the sear 66 is disengaged from the hammer 68, the drawbar 62 has moved out from under the firing pin plunger 74. The plunger spring 106 (referring to FIG. 4) acts on the firing pin plunger to align the narrow middle section 106 with the firing pin 86. Thus, when the hammer 68 strikes the firing pin 86, the firing pin 86 is free to move forward and initiate the round 44.

Figure 24:
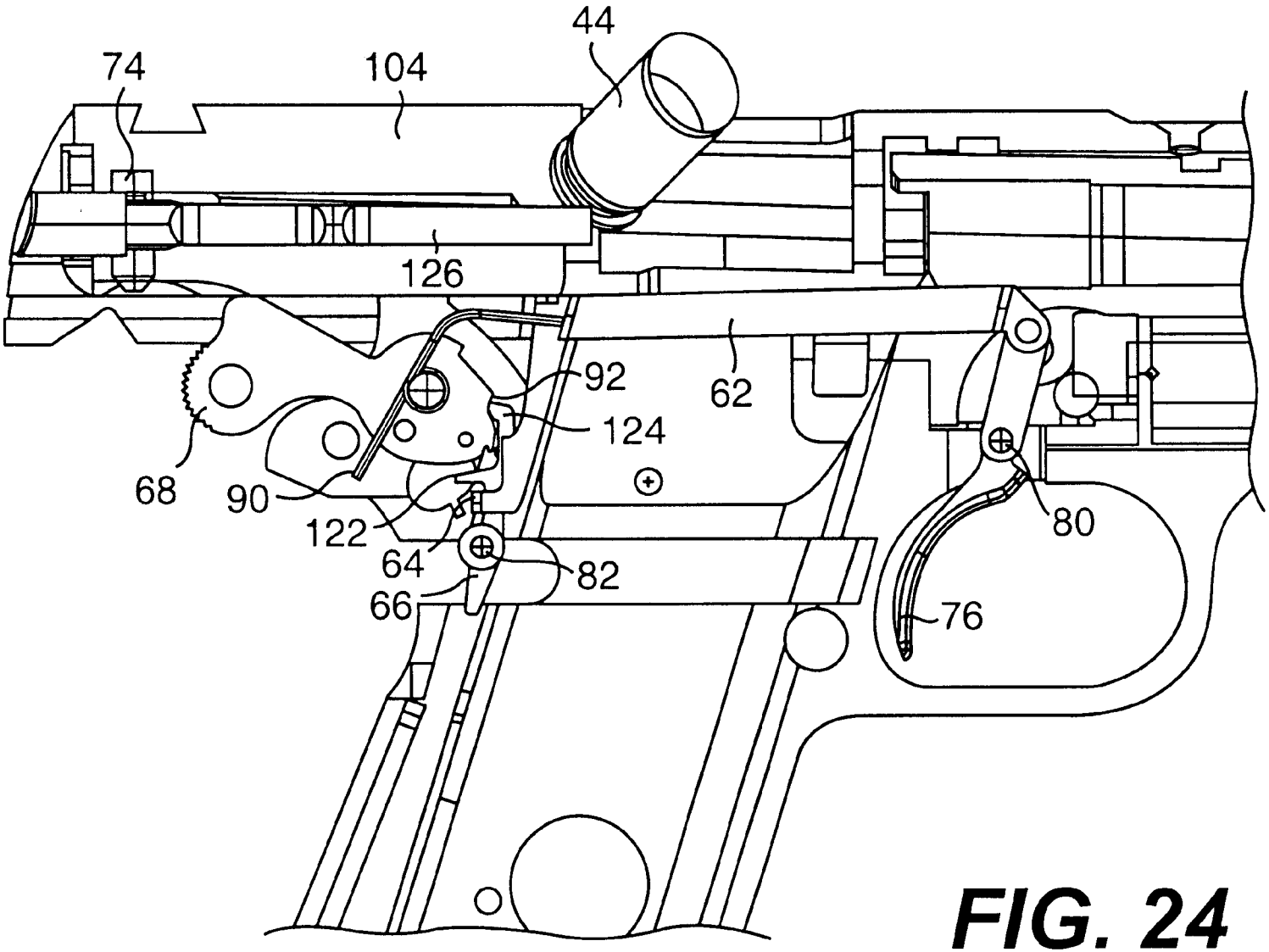
FIG. 24 is a side view of the handgun of FIG. 20, illustrating the fully recoiled position.

The recoil action of the discharged round causes the slide 104 to move rearwardly. As illustrated in FIG. 24, the rearward motion of the slide pushes the drawbar 62 down so that the hammer tab 64 disengages the drawbar contact 122 on the sear 66. This allows the sear spring 70 (referring to FIG. 5) to rotate the sear back into contact with the hammer 68. The rearward motion of the slide also rotates the hammer 68 rearwardly to compress the hammer spring 72. Additionally, the spent cartridge 44 is ejected from the chamber by the extractor 126. The slide 104 then returns to the forward position, allowing the hammer 68 to rotate forward until the hammer contact 124 of the sear 66 engages the cocked notch 92 of the hammer 68. As the slide moves forward, a fresh cartridge is loaded into the chamber.

After the round is fired, the trigger 76 is released. The trigger spring 78 acts on the trigger 76 to return the trigger to the full forward position. This causes the drawbar 62 to move rearwardly and into contact with the rounded edge of the firing pin plunger 74. The stronger drawbar spring 90 forces the firing pin plunger 74 upward to engage the firing pin 86 and lock the firing pin in place. The handgun is now in the cocked position, as illustrated in FIG. 21.

To discharge another round, the trigger 76 is again pulled rearwardly. Since, in this embodiment, the hammer 68 is already cocked, the hammer tab 64 of the drawbar 62 must only contact the sear 66 to release the hammer 68 and discharge the next round. The recoil action of this round will again leave the handgun in the cocked position.

To release the hammer 68 from the cocked position without discharging another round, the de-cocking device 138 of an lever 142 is depressed. As illustrated in FIGS. 14, 15, and 16, the downward motion of the de-cocking device 138 causes the de-cocking lever boss 160 to contact the drawbar contact 122 on the sear 66 and rotate the sear 66 out of engagement with the hammer 68. The hammer spring 72 (referring to FIG. 5) causes the hammer 68 to rotate forward until the hammer boss 170 engages the de-cocking lever boss 160, which prevents the hammer from rotating into contact with the firing pin.

As shown in FIG. 16, when the de-cocking device 138 is released, the de-cocking boss 160 disengages from the drawbar contact 122 and the sear spring 70 causes the sear 66 to rotate back into contact with the hammer 68. The hammer 68 continues to rotate forward until the hammer contact 124 of the sear 66 engages the half-cocked notch 94 of the hammer. The hammer 68 is now held in the half-cocked position. Before discharging another round, the hammer 68 must once again be cocked.

The handgun remains in either the cocked or the half-cocked position as long as the handgun is loaded. Once the final round has been fired and the chamber is empty, the trigger 76 may be pulled to release the hammer 68. Since the chamber is empty, there is no recoil action to force the slide 104 rearwardly and the hammer 68 will remain in the un-cocked position as illustrated in FIG. 20.

A second embodiment will now be described where like or similar parts are identified throughout the drawings by the same reference characters.

In this embodiment and as illustrated in FIGS. 17,18, and 19, the hammer 68 is de-cocked with a cam 182 that engages the sear 66. As the de-cocking lever 142 is depressed, the de-cock lever boss 180 rides along the cam 182. The cam 182 rotates the sear 66 out of engagement with the hammer 68. As shown in FIG. 19, the hammer support member 184 engages the hammer 68 and prevents the hammer 68 from rotating into contact with the firing pin when the sear 66 is disengaged.

When the de-cocking lever 142 is released, the hammer spring 72 (referring to FIG. 5) causes the hammer 68 to rotate forward. As the hammer 68 and hammer support member 184 rotate, the sear 66 also rotates back into contact with hammer 68. The hammer 68 continues the rotation until the hammer contact 124 of the sear 66 engages the half-cocked notch 94 of the hammer 68. The hammer 68 is now in the half-cocked position and must be cocked before the weapon may be discharged.

A third embodiment will now be described where like or similar parts are identified throughout the drawings by the same reference characters.

In this embodiment and as illustrated in FIG. 9, the handgun includes a safety device mounted on the frame of the handgun to prevent accidental discharges of the weapon. When the safety device is in the safe position, the safety catch 148 engages the safety tab 144 of the drawbar 62 to prevent the drawbar from moving into contact with the sear 66 and releasing the hammer 68.

As illustrated in FIG. 10, when a user grips the handgun, the grip 140 slides inwardly causing the safety catch 148 to move away from the safety tab 144 of the drawbar 62. The user may now pull the trigger 76 and the drawbar 62 is free to move and release the hammer 68 to initiate a round.

When the user releases the handgun, the spring 70 acts on the grip 140 to slide the grip 140 rearwardly to the safe position. When the grip 140 returns to the safe position, the catch 148 is again engaged with the safety tab 144 to prevent the drawbar 62 from moving.

A fourth embodiment will now be described where like or similar parts are identified throughout the drawings by the same reference characters.

In this embodiment and as illustrated in FIG. 11, the safety tab 150 is positioned on the sear 66. The catch 148 of the safety device operates to engage and hold the sear 66 so that the sear 66 cannot be disengaged from the hammer 68, thereby preventing the discharge of the handgun. As FIG. 12 illustrates, when the grip 140 slides forward to the firing position, the catch disengages from the sear 66 and the sear 66 is free to rotate and release the hammer 68. When the grip 140 is released, the spring 70 (referring to FIG. 10) acts to return the grip 140 to the safe position where the catch 148 is engaged with the sear 66.

It will be apparent to those skilled in the art that various modifications and variations can be made in the method of manufacture of the present invention and in construction of this handgun without departing from the scope or spirit of the invention. Other embodiments of the invention will be apparent to those skilled in the art from consideration of the specification and practice of the invention disclosed herein. It is a intended that the specification and examples be considered as exemplary only, with a true scope and spirit of the invention being indicated by the following claims.

What is claimed:

1. A semi-automatic handgun, comprising:

a frame;

a slide mounted on the frame for reciprocating movement between a forward position and a rearward position;

barrel pivotally linked to the frame;

a thumb safety having a safe position where the thumb safety engages the slide to prevent the slide from moving relative to the frame;

a firing assembly including a sear and a hammer;

a grip safety having a safe position where the grip safety engages the firing assembly to prevent the hammer from moving; and a drawbar mounted internally to the frame and configured to rotate the hammer into engagement with the sear and further configured to disengage the sear from the hammer to release the hammer.

2. The handgun of claim 1, further comprising a trigger and a trigger pin, the trigger mounted on the trigger pin and connected to the drawbar such that the trigger pivots about the trigger pin to move the drawbar.

3. The handgun of claim 2, further comprising a trigger spring configured to bias the trigger towards a home position.

4. The handgun of claim 1, wherein the sear includes a pivot point, a hammer contact, and a drawbar contact, the hammer contact and the drawbar contact being positioned on the same side of the pivot point.

5. The handgun of claim 1, wherein the drawbar includes a rear leg and a hammer engagement tab projecting from the rear leg, the hammer engagement tab configured to engage the hammer to rotate the hammer into engagement with the sear.

6. The handgun of claim 5, wherein the hammer engagement tab is further configured to contact the sear to disengage the sear from the hammer.

7. The handgun of claim 1, further comprising a drawbar spring configured to bias the drawbar towards the slide.

8. The handgun of claim 1, wherein the grip safety includes a grip disposed in the frame, a safety spring acting on the grip, and a catch configured to engage the sear to prevent the sear from disengaging the hammer when the grip safety is in the safe position.

9. The handgun of claim 1, further comprising a de-cocking device operatively engaged with the firing assembly and configured to rotate the hammer from a cocked position to a half-cocked position.

10. The handgun of claim 9, wherein the hammer includes a half-cocked notch and a boss and the de-cocking device includes a lever having a boss, the lever rotatably disposed in the frame and configured for rotation in a first direction where the sear is disengaged from the hammer and where the boss on the lever engages the boss on the hammer to prevent the hammer from rotating, the lever further configured for rotation in a second direction to allow the half-cocked notch of the hammer to rotate into engagement with the sear.

11. The handgun of claim 1, wherein a portion of the drawbar is engageable with a recess in the slide and a rearward motion of the slide moves the portion of the drawbar out of the recess in the slide to disconnect the drawbar from the firing mechanism.

* * * * *

UNITED STATES PATENT AND TRADEMARK OFFICE

CERTIFICATE OF CORRECTION

PATENT NO. : 6,415,702 B1
DATED : July 9, 2002
INVENTOR(S) : Szabo et al.

It is certified that error appears in the above-identified patent and that said Letters Patent is hereby corrected as shown below:

Column 9,
Line 46, insert -- a -- before "barrel".

Signed and Sealed this

Twenty-sixth Day of November, 2002

*Attest:*

*Attesting Officer*

JAMES E. ROGAN
*Director of the United States Patent and Trademark Office*